US008469284B2

(12) United States Patent
Ueda et al.

(10) Patent No.: US 8,469,284 B2
(45) Date of Patent: Jun. 25, 2013

(54) PEARLITIC RAIL WITH EXCELLENT WEAR RESISTANCE AND TOUGHNESS

(75) Inventors: Masaharu Ueda, Tokyo (JP); Takashi Morohoshi, Tokyo (JP); Kazunori Seki, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 4 days.

(21) Appl. No.: 13/201,573

(22) PCT Filed: Jan. 21, 2010

(86) PCT No.: PCT/JP2010/000339

§ 371 (c)(1),
(2), (4) Date: Aug. 15, 2011

(87) PCT Pub. No.: WO2010/095354

PCT Pub. Date: Aug. 26, 2010

(65) Prior Publication Data

US 2011/0303756 A1 Dec. 15, 2011

(30) Foreign Application Priority Data

Feb. 18, 2009 (JP) ..... 2009-035472

(51) Int. Cl.
*E01B 5/00* (2006.01)

(52) U.S. Cl.
USPC ..... 238/150; 148/584

(58) Field of Classification Search
USPC ..... 238/150, 122; 148/320, 332–336, 148/902, 581, 584, 585
See application file for complete search history.

(56) References Cited

U.S. PATENT DOCUMENTS

| | | | | |
|---|---|---|---|---|
| 5,382,307 | A | 1/1995 | Kageyama et al. | |
| 5,645,653 | A * | 7/1997 | Jerath et al. | 148/320 |
| 5,762,723 | A * | 6/1998 | Ueda et al. | 148/320 |
| 6,254,696 | B1 * | 7/2001 | Ueda et al. | 148/333 |
| 7,217,329 | B2 * | 5/2007 | Cordova | 148/584 |
| 7,288,159 | B2 * | 10/2007 | Cordova | 148/584 |
| 7,416,622 | B2 * | 8/2008 | Kuppers et al. | 148/581 |
| 7,608,154 | B2 * | 10/2009 | O-hashi et al. | 148/309 |
| 7,955,445 | B2 * | 6/2011 | Honjo et al. | 148/333 |

(Continued)

FOREIGN PATENT DOCUMENTS

| | | |
|---|---|---|
| CA | 2 734 980 A1 | 5/2010 |
| CA | 2 764 769 A1 | 12/2010 |

(Continued)

OTHER PUBLICATIONS

International Search Report, PCT/JP2010/000339, Mar. 23, 2010.

(Continued)

*Primary Examiner* — Jason C Smith
(74) *Attorney, Agent, or Firm* — Birch, Stewart, Kolasch & Birch, LLP

(57) ABSTRACT

This pearlitic rail consists of a steel including: in terms of percent by mass, C: 0.65% to 1.20%; Si: 0.05% to 2.00%; Mn: 0.05% to 2.00%; and REM: 0.0005% to 0.0500%, with the balance being Fe and inevitable impurities, wherein, in a head portion of the rail, a head surface portion which ranges from surfaces of head corner portions and a head top portion to a depth of 10 mm has a pearlite structure, and the hardness Hv of the head surface portion is in a range of 320 to 500.

6 Claims, 5 Drawing Sheets

U.S. PATENT DOCUMENTS

| | | | | |
|---|---|---|---|---|
| 7,972,451 | B2 * | 7/2011 | Ueda et al. | 148/320 |
| 8,210,019 | B2 * | 7/2012 | Ueda et al. | 72/364 |
| 2004/0035507 | A1 * | 2/2004 | Cordova | 148/584 |
| 2004/0187981 | A1 * | 9/2004 | Ueda et al. | 148/584 |
| 2007/0181231 | A1 * | 8/2007 | Ueda et al. | 148/584 |
| 2008/0011393 | A1 * | 1/2008 | Ueda et al. | 148/584 |
| 2010/0116381 | A1 * | 5/2010 | Honjo et al. | 148/584 |
| 2011/0155821 | A1 * | 6/2011 | Ueda et al. | 238/150 |
| 2011/0226389 | A1 * | 9/2011 | Ueda et al. | 148/330 |
| 2011/0303756 | A1 * | 12/2011 | Ueda et al. | 238/150 |
| 2012/0076685 | A1 | 3/2012 | Honjo et al. | |
| 2012/0087825 | A1 * | 4/2012 | Miyazaki et al. | 420/99 |

FOREIGN PATENT DOCUMENTS

| | | | |
|---|---|---|---|
| CN | 1793402 | A | 6/2006 |
| CN | 1884606 | A | 12/2006 |
| EP | 0754775 | A1 | 1/1997 |
| EP | 0770695 | A1 | 5/1997 |
| JP | 46-21090 | | 6/1971 |
| JP | 52-101624 | | 8/1977 |
| JP | 63-128123 | A | 5/1988 |
| JP | 5-171247 | A | 7/1993 |
| JP | 5-263121 | A | 10/1993 |
| JP | 6-279928 | A | 10/1994 |
| JP | 7-173530 | A | 7/1995 |
| JP | 8-104946 | A | 4/1996 |
| JP | 8-246100 | A | 9/1996 |
| JP | 9-111352 | A | 4/1997 |
| JP | 2000-178690 | A | 6/2000 |
| JP | 2000226636 | | 8/2000 |
| JP | 2000345296 | | 12/2000 |
| JP | 2001020040 | | 1/2001 |
| JP | 2001-220651 | A | 8/2001 |
| JP | 2001-234238 | A | 8/2001 |
| JP | 2002-226915 | A | 8/2002 |
| JP | 2002-302737 | A | 10/2002 |
| JP | 2002-363696 | A | 12/2002 |
| JP | 2002-363702 | A | 12/2002 |
| JP | 2003-105499 | A | 4/2003 |
| JP | 2003-129180 | A | 5/2003 |
| JP | 2004-43865 | A | 2/2004 |
| JP | 2004043963 | A | 2/2004 |
| JP | 2004-76112 | A | 3/2004 |
| JP | 2005-256023 | A | 9/2005 |
| JP | 2005-350723 | A | 12/2005 |
| JP | 2006-111939 | A | 4/2006 |
| JP | 2007-169727 | A | 7/2007 |
| JP | 2007-291413 | A | 11/2007 |
| JP | 2008-13811 | A | 1/2008 |
| JP | 2008-50684 | A | 3/2008 |
| RU | 2107740 | C1 | 3/1998 |
| RU | 2136767 | C1 | 9/1999 |
| RU | 2194791 | C1 | 12/2002 |
| RU | 2259416 | C2 | 8/2005 |
| RU | 2 295 587 | C1 | 3/2007 |
| SU | 720047 | A | 3/1980 |

OTHER PUBLICATIONS

European Search Report dated Jun. 26, 2012 for European Patent Application No. 10743487.0.

Decision on Grant dated Apr. 3, 2012 for Russian Application No. 2011110256 with English translation.

International Search Report dated Jun. 29, 2010 for PCT/JP2010/002708.

International Search Report, PCT/JP2009/005800, Feb. 2, 2010.

JIS E 1101-1990 and English Abstract.

Office Action for Canadian Application No. 2,734,980, dated Oct. 25, 2012.

U.S. Appl. No. 13/061,001, filed Feb. 25, 2011.

U.S. Appl. No. 13/261,069, filed Dec. 8, 2011.

Russian Notice of Allowance and English Translation for Application No. 2011131245 mailed Jan. 16, 2013.

Russian Notice of Allowance and English Translation for Application No. 2011152194 mailed Feb. 15, 2013.

US Office Action, dated Apr. 2, 2013, for U.S. Appl. No. 13/261,069.

* cited by examiner

PEARLITIC RAIL WITH EXCELLENT WEAR RESISTANCE AND TOUGHNESS

TECHNICAL FIELD

The present invention relates to a pearlitic rail used for freight railways in overseas in which both of the wear resistance and toughness are improved at the head portion.

The present application claims priority on Japanese Patent Application No. 2009-035472 filed on Feb. 18, 2009, the content of which is incorporated, herein by reference.

BACKGROUND ART

In conjunction with economic development, new development of natural resources, such as coal or the like, is progressing. Specifically, mining is underway at regions with a severe natural environment which have not so far been developed. Accordingly, the track environment is becoming remarkably severe in overseas freight railways used to transport natural resources. There is a demand for rails to have toughness or the like in regions with cold weather in addition to higher wear resistance than ever. In such circumstances, there is a demand to develop rails having higher wear resistance and higher toughness than those of presently-used high-strength rails.

In general, it is known that the refinement of a pearlite structure, specifically, grain refining in an austenite structure which is yet to be transformed into pearlite or the refinement of pearlite blocks is effective to improve the toughness of a pearlite steel. In order to achieve grain refining in an austenite structure, during a hot rolling, the rolling temperature is decreased and the rolling reduction rate is increased and, furthermore, a heat treatment by low-temperature reheating after the hot rolling of rails is implemented. In addition, in order to achieve the refinement of a pearlite structure, pearlite transformation starting from the inside of austenite grains is accelerated by utilizing transformation nuclei or the like.

However, in the manufacturing of rails, from the viewpoint of ensuring formability during the hot rolling, there are limitations on a decrease in the rolling temperature and an increase in the rolling reduction rate; and thereby, sufficient refinement of austenite grains could not be achieved. In addition, with regard to the pearlite transformation from the inside of austenite grains by utilizing transformation nuclei, there are problems in that the amount of transformation nuclei is difficult to control, and the pearlite transformation from the inside of grains is not stable; and thereby, sufficient refinement of a pearlite structure could not be achieved.

Due to these problems, a method has been applied to fundamentally improve the toughness of rails having a pearlite structure in which low-temperature reheating is conducted after hot rolling a rail, and then pearlite transformation is performed by accelerated cooling so as to refine a pearlite structure. However, recently, rails have been made to include a high content of carbon for improving the wear resistance; and therefore, there is a problem in that coarse carbides remain inside austenite grains during the above-described low-temperature reheating treatment, which lowers the ductility and toughness of a pearlite structure after the accelerated cooling. In addition, since this method includes reheating, there is another problem in regard to economic efficiency, such as a high manufacturing cost, a low productivity or the like.

Consequently, there is a demand to develop a method for manufacturing a high-carbon steel rail that ensures the formability during hot rolling and refines the pearlite structure after hot rolling. In order to solve this problem, methods for manufacturing a high-carbon steel rail shown below have been developed. The major characteristics of those methods for manufacturing a rail are that the following finding is utilized so as to refine the pearlite structure; and the finding is that austenite grains in a high-carbon steel are easily recrystallized at relatively low temperatures and even with a small rolling reduction rate. As a result, fine grains with similar grain diameters are obtained by continuous rolling under a small rolling reduction rate; and thereby, the ductility and toughness of a pearlite steel is improved (for example, Patent Documents 1, 2 and 3).

In a technology disclosed by Patent Document 1, 3 or more continual passes of rolling are conducted with a predetermined interval of time in the finish rolling of a high carbon steel rail; and thereby, a rail having high ductile can be provided.

In a technology disclosed by Patent Document 2, two or more continual passes of rolling are conducted with a predetermined interval of time in the finish rolling of a high carbon steel rail, and furthermore, accelerated cooling is conducted after the continuous rolling. As a result, a rail having superior wear resistance and high toughness can be provided.

In a technology disclosed by Patent Document 3, cooling is conducted between passes of rolling in the finish rolling of a high-carbon steel rail, and conducting accelerated cooling is conducted after the continuous rolling. As a result, a rail having superior wear resistance and high toughness can be provided.

The technologies disclosed by Patent Documents 1 to 3 can achieve the refinement of an austenite structure at a certain level and exhibit a slight improvement in toughness by the combination of the temperature, the number of rolling passes, and the interval of time between passes during the continuous hot rolling. However, there is a problem in that these technologies do not exhibit any effects in regard to fracture starting from inclusions present inside the steel; and thereby, the toughness is not fundamentally improved.

Considering these circumstances, the addition of Ca, the reduction of the oxygen content, and the reduction of the Al content have been studied in order to suppress the generation of typical inclusions in rails, that is, MnS or $Al_2O_3$. The characteristics of these manufacturing methods are that MnS is changed to CaS by adding Ca in the preliminary treatment of hot metal so as to become harmless, and furthermore, the oxygen content is reduced as much as possible by adding deoxidizing elements or applying a vacuum treatment so as to reduce the amount of inclusions in molten steel, and technologies of which have been studied (for example, Patent Documents 4, 5 and 6).

The technology in Patent Document 4 discloses a method for manufacturing a high-carbon silicon-killed high-cleanliness molten steel in which the added amount of Ca is optimized to fix S as CaS; and thereby, the amount of elongated MnS-based inclusions is reduced. In this technology, S which segregates and concentrates in a solidification process reacts with Ca which similarly segregates and concentrates or calcium silicate generated in the molten steel; and thereby, S is sequentially fixed as CaS. As a result, the generation of elongated MnS inclusions is suppressed.

The technology in Patent Document 5 discloses a method for manufacturing a high-carbon high-cleanliness molten steel in which the amount of MnO inclusions is reduced; and thereby, the amount of elongated MnS inclusions precipitated from MnO is reduced. In this technology, a steel is tapped in a non-deoxidized or weakly deoxidized state after being melted in an atmosphere refining furnace, and then a vacuum treatment is conducted at a degree of vacuum of 1 Torr or less so as to make the dissolved oxygen content be in a range of 30 ppm or less. Next, Al and Si are added, and then Mn is added. Thereby, the number of secondary deoxidization products is reduced which will become crystallization nuclei of MnS that crystallizes out in finally solidified portions, and the concentration of MnO in oxides is lowered. Thereby, the crystallization of MnS is suppressed.

The technology in Patent Document 6 discloses a method for manufacturing a high-carbon high-cleanliness molten steel with reduced amounts of oxygen and Al in the molten steel. In this technology, a rail having superior damage resistance can be manufactured by limiting the total amount of oxygen based on the relationship between the total oxygen value in oxide-based inclusions and the damage property. Furthermore, the damage resistance of rails can be further improved by limiting the amount of solid-soluted Al or the composition of inclusions in a preferable range.

The above-described technologies disclosed in Patent Documents 4 to 6 control the configurations and amounts of MnS and Al-based inclusions generated in a bloom stage. However, the configuration of inclusions is altered during hot rolling in the rolling of rails. In particular, Mn sulfide-based inclusions elongated in the longitudinal direction by rolling act as the starting points of fracture in rails; and therefore, there is a problem in that the toughness of rails cannot be stably improved in the case where only the inclusions in the bloom stage is controlled.

From such circumstances, it has become desirable to provide a pearlitic rail having superior wear resistance and toughness in which both the wear resistance and toughness of a pearlite structure are improved.

PRIOR ART DOCUMENTS

Patent Documents

Patent Document 1: Japanese Unexamined Patent Application Publication No. H07-173530

Patent Document 2: Japanese Unexamined Patent Application Publication No. 2001-234238

Patent Document 3: Japanese Unexamined Patent Application Publication No. 2002-226915

Patent Document 4: Japanese Unexamined Patent Application Publication No. H05-171247

Patent Document 5: Japanese Unexamined Patent Application Publication No. H05-263121

Patent Document 6: Japanese Unexamined Patent Application Publication No. 2001-220651

DISCLOSURE OF THE INVENTION

Problems to be Solved by the Invention

The present invention has been made in consideration of the above problems, and the object of the present invention is to provide a pearlitic rail in which both of wear resistance and toughness are improved at the head portion that are particularly in demand as a rail for freight railways in overseas.

Means for Solving the Problems

The pearlitic rail according to the present invention consists of a steel including: in terms of percent by mass, C, 0.65% to 1.20%; Si: 0.05% to 2.00%; Mn: 0.05% to 2.00%; and REM: 0.0005% to 0.0500%, with the balance being Fe and inevitable impurities, wherein, in a head portion of the rail, a head surface portion which ranges from surfaces of head corner portions and a head top portion to a depth of 10 mm has a pearlite structure, and the hardness Hv of the head surface portion is in a range of 320 to 500.

Here, the Hv refers to the Vickers hardness defined by JIS B7774.

In the pearlitic rail according to the present invention, an average value of ratios (L/D) of long side lengths (L) to short side lengths (D) of Mn sulfide-based inclusions observed in an arbitrary cross-section taken along a longitudinal direction of the pearlite structure may be in a range of 5.0 or lower.

The steel may further includes, in terms of percent by mass, S≦0.0100%, and Mn sulfide-based inclusions having long side lengths (L) in a range of 1 μm to 50 μm may be present at an amount per unit area in a range of $10/mm^2$ to $100/mm^2$ in an arbitrary cross-section taken along the longitudinal direction of the pearlite structure.

The steel may further include, in terms of percent by mass, one or more selected from the group consisting of the following steel components (1) to (11).

(1) either one or both of Ca: 0.0005% to 0.0150% and Al: 0.0040% to 0.50%

(2) Co: 0.01% to 1.00%

(3) either one or both of Cr: 0.01% to 2.00% and Mo: 0.01% to 0.50%

(4) either one or both of V: 0.005% to 0.50% and Nb: 0.002% to 0.050%

(5) B: 0.0001% to 0.0050%

(6) Cu: 0.01% to 1.00%

(7) Ni: 0.01% to 1.00%

(8) Ti: 0.0050% to 0.0500%

(9) Mg: 0.0005% to 0.0200%

(10) Zr: 0.0001% to 0.2000%

(11) N: 0.0060 to 0.0200%

Effects of the Invention

In accordance with the present invention, the components, microstructure, and hardness of a rail steel are controlled, and in addition, REM is added. Thereby, the wear resistance and the toughness of a pearlite structure are improved; and as a result, it is possible to improve the usable period (service life) of a rail, particularly, for freight railways in overseas (overseas freight railways). Furthermore, in the case where the number of Mn sulfide-based inclusions is controlled by controlling the configurations of Mn sulfide-based inclusions and reducing the added amount of S, it is possible to further improve the toughness of the pearlite structure; and as a result, it is possible to further improve the usable period.

BEST MODE FOR CARRYING OUT THE INVENTION

Hereinafter, pearlitic rails with excellent wear resistance and toughness will be described in detail as embodiments of the present invention. Hereinafter, masses in compositions will be expressed simply as '%'.

Figure 1:
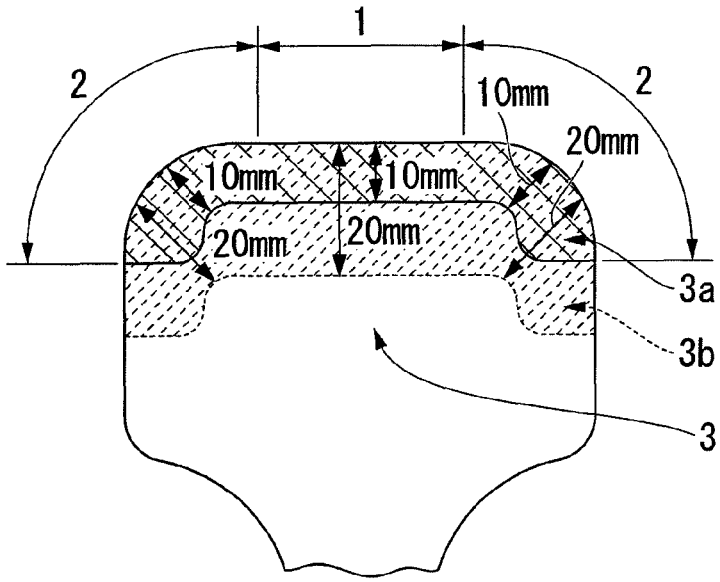
FIG. 1 is a view showing nominal designations of portions in a transverse cross-section (a cross-section perpendicular to the longitudinal direction) of the rail steel according to the present invention.

FIG. 1 is a cross-section perpendicular to the longitudinal direction of the pearlitic rail with excellent wear resistance and toughness according to the present invention. A rail head portion 3 includes a head top portion 1 and head corner portions 2 situated at both ends of the head top portion 1. One of the head corner portions 2 is a gauge corner (G. C.) portion that mainly comes into contact with wheels.

A portion ranging from surfaces of the head corner portions 2 and the head top portion 1 to a depth of 10 mm is called a head surface portion (reference numeral: 3*a*, the solid line area). In addition, a portion ranging from the surfaces of the head corner portions 2 and the head top portion 1 to a depth of 20 mm is denoted with a reference numeral of 3*b* (the dotted line area).

At first, the inventors of the present invention ascertained the generation mechanism of Mn sulfide-based inclusions elongated in the longitudinal direction which have an adverse influence on the toughness of a rail. In a process of rolling a rail, a bloom is reheated to a temperature in a range of 1200° C. to 1300° C., and then the bloom is subjected to hot rolling. The relationship between these rolling conditions and the configuration of MnS was investigated. As a result, it was observed that, in the case where the rolling temperature was high or in the case where the rolling reduction rate was high during rolling, plastic deformation of soft Mn sulfide-based inclusions easily occurred; and thereby, the Mn sulfide-based inclusions were easily elongated in the longitudinal direction of the rail.

Next, the inventors studied methods for suppressing the elongation of Mn sulfide-based inclusions. As a result of experiments of rail hot rolling in which rolling temperatures and rolling reduction rates were varied during hot rolling, it was confirmed that the elongation of Mn sulfide-based inclusions could be suppressed by lowering the rolling temperature. However, in the process of rolling the rail, the lowering of the rolling temperature makes it difficult to secure formability; and therefore, it became evident that it is difficult to suppress the elongation by controlling the rolling temperature.

In view of these circumstances, the inventors studied methods to suppress the elongation of Mn sulfide-based inclusions themselves. Various test melting and hot rolling experiments were conducted in which configurations of generated MnS were varied in different manners. As a result, it was confirmed that the elongation could be suppressed by hardening inclusions which acted as nuclei of the Mn sulfide-based inclusions.

Furthermore, the inventors studied hard inclusions which acted as the nuclei of Mn sulfide-based inclusions during hot rolling. As a result of hot rolling experiments using oxides with high melting points, it was found that oxysulfides of REM with high melting points ($REM_2O_2S$) had a high consistency with Mn sulfide-based inclusions; and thereby, Mn sulfide-based inclusions were generated efficiently using the oxysulfides as nuclei.

Next, the inventors performed test melting and hot rolling experiments of steels including REM. As a result, it was confirmed that Mn sulfide-based inclusions generated from the nuclei of oxysulfides of REM were rarely elongated after hot rolling; and consequently, the number (amount) of Mn sulfide-based inclusions elongated in the longitudinal direction was decreased. Furthermore, as a result of impact tests using these steels, it was confirmed that, with regard to steels in which REM was added and the number of elongated Mn sulfide-based inclusions was small, the number of starting points for fracture was decreased; and as a result, the impact values were improved.

Furthermore, in order to further suppress the elongation of Mn sulfide-based inclusions, the inventors studied methods for finely dispersing oxysulfides of REM through test melting and hot rolling experiments. As a result, it was confirmed that, by adjusting deoxidization conditions when adding REM, oxysulfides of REM were finely dispersed; and consequently, the configuration of Mn sulfide-based inclusions after hot rolling could be controlled.

In addition to the control of the configuration of Mn sulfide-based inclusions, the inventors studied whether or not toughness was improved in the case where the total number (amount) of Mn sulfide-based inclusions was reduced by decreasing the added amount of S. Test melting and hot rolling experiments were performed using steels in which REM was added and the added amount of S was varied. As a result, it was confirmed that in the case where the number (amount) of Mn sulfide-based inclusions was reduced by decreasing the added amount of S, the number of starting points for fracture was drastically reduced; and thereby, the impact values were further improved.

The inventors conducted a test melting of experimental steels by adding REM to steels including carbon at a content of 1.00%. Next, the inventors conducted a laboratory rolling test which simulated the equivalent hot rolling conditions for rails. Then, the inventors conducted an impact test, and investigated the effect of the ratios (L/D) of the long side lengths (L) to the short side lengths (D) of Mn sulfide-based inclusions on impact values. Here, the hardness of materials was set to an Hv level of 400 by controlling heat treatment conditions.

Figure 2:
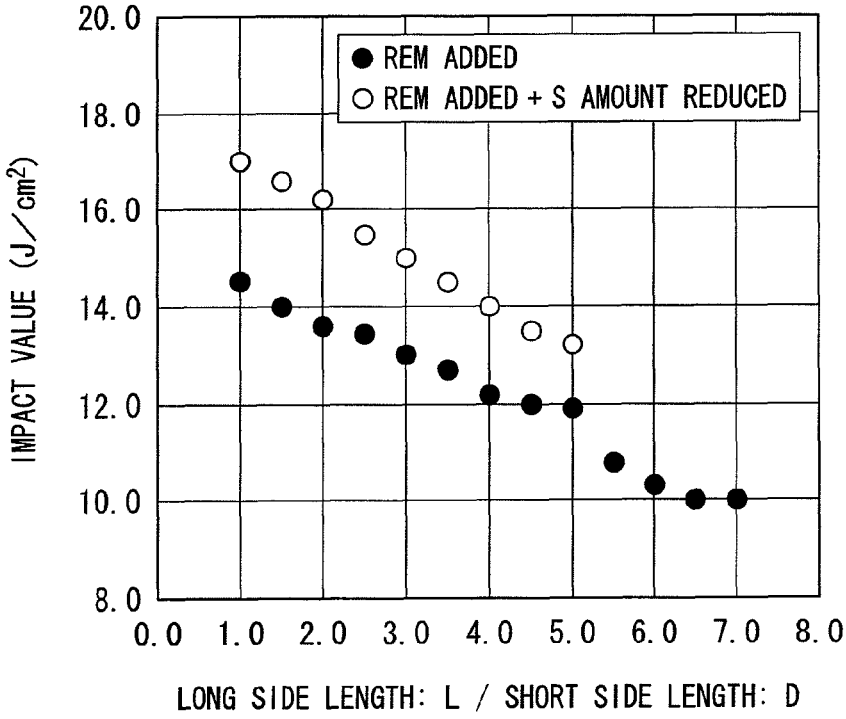
FIG. 2 is a view showing the relationship between the average value of the ratios (L/D) of the long side lengths (L) to the short side lengths (D) of Mn sulfide-based inclusions and the impact value which are results obtained by subjecting steels in which the amount of carbon is 1.00% and REM is further added to a laboratory rolling test that simulates equivalent rolling conditions for rails, and conducting an impact test.

FIG. 2 shows the relationship between the average value of the ratios (L/D) of the long side lengths (L) to the short side lengths (D) of Mn sulfide-based inclusions and the impact value with regard to steels including carbon at an amount of 1.00%. By adjusting deoxidization conditions during REM is added, the average value of the ratios (L/D) of the long side lengths (L) to the short side lengths (D) of Mn sulfide-based inclusions which are observed on an arbitrary cross-section taken along the longitudinal direction becomes in a range of 5.0 or lower, and impact values are improved. Furthermore, in the case where the added amount of S is reduced, the number (amount) of Mn sulfide-based inclusions is reduced, and the number of starting points for fracture is drastically reduced. As a result, the impact values are further improved.

From the results of these material tests, it was confirmed that, in order to improve the toughness of high carbon-containing rail steels with excellent wear resistance, the control of the configuration of Mn sulfide-based inclusions, that is, an addition of REM was effective. Furthermore, it was newly found that there was an optimal range of the configuration of Mn sulfide-based inclusions formed by utilizing REM as nuclei in order to improve toughness, and, furthermore, it was also found that toughness was further improved by reducing the added amount of S.

That is, in the present invention, REM is added to a high-carbon containing steel rail; and thereby, the wear resistance and toughness of a pearlite structure are improved. As a result, particularly, it becomes possible to improve the usable period (service life) of the rail for overseas freight railways. In addition, the configuration of Mn sulfide-based inclusions is controlled, and furthermore, the number (amount) of Mn sulfide-based inclusions is controlled by reducing the added amount of S. As a result, the toughness of a pearlite structure is further improved. Thereby, the present invention provides a pearlitic rail for the purpose of improving a usable period (service life) of the rail.

Next, the reasons why the present invention is limited (with regard to the features) will be described in detail. Hereinafter, '% by mass' in compositions will be denoted simply with '%'.

(1) The Reasons why the Chemical Components are Limited

The reasons why the chemical components of rail steels are limited within the above-described numeric ranges in the pearlitic rail according to the present invention will be described in detail.

C is an effective element that accelerates pearlite transformation and secures wear resistance. In the case where the amount of C is less than 0.65%, it is not possible to maintain the minimum level of strength or wear resistance that is required for rails. In addition, in the case where the amount of C exceeds 1.20%, a large number of coarse proeutectoid cementite structure is generated; and thereby, the wear resistance and toughness are degraded. Therefore, the amount of C is limited to be in a range of 0.65% to 1.20%. Here, it is preferable that the amount of C is in a range of 0.90% or more in order to sufficiently secure wear resistance.

Si is an essential element as a deoxidizing material. In addition, Si is an element that increases the hardness (strength) of a rail head portion by solid solution strengthening in the ferrite phase in a pearlite structure. Furthermore, Si is an element that suppresses the generation of proeutectoid cementite structure in a hypereutectoid steel; and thereby, a decrease in toughness is suppressed. However, in the case where the amount of Si is less than 0.05%, it is not possible to sufficiently expect such effects. In addition, in the case where the amount of Si exceeds 2.00%, a large amount of surface defects are generated during hot rolling, and weldability is degraded due to the generation of oxides. Furthermore, hardenability is remarkably increased, and a martensite structure is generated which is harmful to the wear resistance and toughness of the rail. Therefore, the amount of Si is limited to be in a range of 0.05% to 2.00%. Here, it is preferable that the amount of Si is in a range of 0.25% to 1.25% in order to ensure hardenability and suppress the generation of martensite structure which is harmful to wear resistance and toughness.

Mn is an element that increases hardenability and refines pearlite lamellar spacing; and thereby, the hardness of the pearlite structure is ensured and wear resistance is improved. However, in the case where the amount of Mn is less than 0.05%, such effects become small, and it becomes difficult to ensure wear resistance necessary for the rail. In addition, in the case where the amount of Mn exceeds 2.00%, hardenability is remarkably increased, and martensite structure is easy to generate which is harmful to wear resistance and toughness. Therefore, the added amount of Mn is limited to be in a range of 0.05% to 2.00%. Here, it is preferable that the amount of Mn is in a range of 0.20% to 1.35% in order to ensure hardenability and suppress the generation of martensite structure which is harmful to wear resistance and toughness.

REM is a deoxidizing and desulfurizing element, and by adding REM, oxysulfides of REM ($REM_2O_2S$) are generated, and these act as nuclei for the generation of Mn sulfide-based inclusions. In addition, since the melting point of oxysulfides ($REM_2O_2S$) which act as nuclei is high, REM is an element that suppresses the elongation of Mn sulfide-based inclusions after rolling. However, in the case where the amount of REM is less than 0.0005%, the effects are small, and REM cannot sufficiently act as nuclei for the generation of Mn sulfide-based inclusions. In addition, in the case where the amount of REM exceeds 0.0500%, the number (amount) of oxysulfides of REM ($REM_2O_2S$) becomes excessive; and thereby, the number (amount) of isolated (independent) oxysulfides of REM ($REM_2O_2S$) that do not act as the nuclei of Mn sulfide-based inclusions are increased. These hard oxysulfides ($REM_2O_2S$) greatly degrade the toughness of the rail steel. Therefore, the added amount of REM is limited to be in a range of 0.0005% to 0.0500%. Here, in order to improve impact values by reliably suppressing the generation of elongated Mn sulfide-based inclusions and suppressing in advance the generation of hard oxysulfides of ($REM_2O_2S$) that do not act as the nuclei of Mn sulfide-based inclusions and are harmful to toughness, the added amount of REM is preferably set to be in a range of 0.0010% to 0.0300%.

Here, REM refers to rare earth metals that are one or more selected from Sc, Y, La, Ce, Pr, Nd, Pm, Sm, Eu, Gd, Tb, Dy, Ho, Er, Tm, Yb, and Lu. The above-described added amount includes the amounts of all of the added REMs. As long as the sum of the amounts of all of the added REMs is within the above-described range, either sole or combined (two or more) rare earth metals can exhibit the same effects.

In the present invention, it is preferable to limit the amount of S in the following manner. The reasons why the amount of S is limited will be described in detail.

S is an element that generates Mn sulfide-based inclusions harmful to toughness. In the case where the amount of S exceeds 0.0100%, the number (amount) of Mn sulfide-based inclusions is increased; and thereby, remarkable improvement of toughness cannot be achieved. Therefore, the added amount of S is limited to 0.0100% or less. Here, there is no limitation on the lower limit; however, in order to secure a minimum level of Mn sulfide-based inclusions for suppressing hydrogen defects and, at the same time, to improve toughness, the amount of S is preferably in a range of 0.0020% to 0.0080%.

In addition, it is preferable to add elements of Ca, Al, Co, Cr, Mo, V, Nb, B, Cu, Ni, Ti, Mg, Zr, or N to the rail manufactured with the above-described composition according to necessity for the purposes of improvement of the hardness (strengthening) of a pearlite structure or a proeutectoid ferrite structure, improvement of toughness of a pearlite structure, prevention of softening of weld heat-affected zones, and control of hardness distribution in a cross-section of the rail head portion.

Herein, the main purposes of adding the above-described elements are shown below.

Ca and Al form oxides having high melting points and these oxides act as the nuclei of Mn sulfide-based inclusions; and thereby, the elongation of Mn sulfide-based inclusions is suppressed, and toughness is improved.

Co refines lamellar structures on rolling contact surfaces and also refines ferrite grains; and thereby, the wear resistance of a pearlite structure is increased.

Cr and Mo increase the equilibrium transformation point of pearlite, and mainly refine pearlite lamellar spacing; and thereby, the hardness of a pearlite structure is ensured.

V and Nb generate carbides and nitrides in a hot rolling process and a subsequent cooling process; and thereby, the growth of austenite grains is suppressed. Furthermore, V and Nb precipitate and harden in a ferrite structure and a pearlite structure; and thereby, the toughness and hardness of a pearlite structure are improved. In addition, V and Nb stably generate carbides and nitrides; and thereby, the softening of welded joint heat-affected zones is prevented.

B reduces the dependency of the pearlite transformation temperature on a cooling rate; and thereby, the hardness distribution in the rail head portion is made uniform.

Cu is solid-solubilized in a ferrite structure and in a ferrite phase in a pearlite structure; and thereby, the hardness of the pearlite structure is increased.

Ni improves the toughness and hardness of a ferrite structure and a pearlite structure, and simultaneously, Ni prevents the softening of welded joint heat-affected zones.

Ti refines the structure in weld heat-affected zones and prevents the embrittlement of welded joint heat-affected zones.

Mg refines austenite grains during the hot-rolling of the rail, and, at the same time, accelerates ferrite or pearlite transformation; and thereby, toughness is improved.

Zr suppress the formation of segregation zones in the middle of a casting bloom because $ZrO_2$ inclusions act as solidification nuclei in a high-carbon rail steel and the rate of equiaxial crystallization of solidified structures is increased. As a result, the lowering of the toughness of the rail is prevented.

N segregates in austenite grain boundaries; and thereby, pearlite transformation is accelerated. In addition, N refines the size of pearlite blocks; and thereby, toughness is improved.

The reasons why these components are limited will be described in detail hereinafter.

Similarly to REM, Ca is a deoxidizing and desulfurizing element, and aggregates of oxides and sulfides of calcium (CaO—CaS) are generated by the addition of Ca. These aggregates act as nuclei for generation of Mn sulfide-based inclusions; and thereby, the elongation of Mn sulfide-based inclusions is suppressed after hot rolling. Furthermore, when added with REM, Ca generates complex oxides with oxysulfides of REM ($REM_2O_2S$). These complex oxides further suppress the elongation of Mn sulfide-based inclusions. In the case where the amount of Ca is less than 0.0005%, the effects are small, and the aggregates cannot sufficiently act as nuclei for generation of Mn sulfide-based inclusions. In addition, in the case where the amount of Ca exceeds 0.0150%, the amount of independent hard CaO that does not act as the nuclei of Mn sulfide-based inclusions is increased depending on the amount of oxygen in a steel. As a result, the toughness of the rail steel is greatly degraded. Therefore, the added amount of Ca is limited to be in a range of 0.0005% to 0.0150%.

Al is a deoxidizing element that generates alumina ($Al_2O_3$), and these oxides act as nuclei for the generation of Mn sulfide-based inclusions; and thereby, the elongation of Mn sulfide-based inclusions after rolling is suppressed. In addition, Al is an element that raises the eutectoid transformation temperature to a higher temperature, and Al contributes to an increase in the hardness (strength) of a pearlite structure. However, in the case where the amount of Al is less than 0.0040%, the effect is weak. In addition, in the case where the amount of Al exceeds 0.50%, it becomes difficult to solid-solubilize Al in a steel; and thereby, coarse alumina-based inclusions are generated. As a result, toughness of a rail is degraded, and simultaneously, fatigue damage occurs due to coarse precipitates. Furthermore, oxides are generated during welding; and thereby, weldability is degraded remarkably. Accordingly, the amount of Al is limited to be in a range of 0.0040% to 0.50%.

Co is solid-solubilized in a ferrite phase in a pearlite structure. Thereby, fine ferrite structure formed by the contact with wheels at the rolling contact surface of the rail head portion is further refined; and as a result, wear resistance is improved. In the case where the amount of Co is less than 0.01%, the refinement of ferrite structure is not achieved; and therefore, it is not possible to expect the effect of improving the wear resistance. In addition, even in the case where the amount of Co exceeds 1.00%, the above-described effect is saturated; and therefore, the refinement of ferrite structure corresponding to the added amount of Co is not achieved. In addition, an increase in the cost for adding alloy elements degrades economic efficiency. Therefore, the amount of Co is limited to be in a range of 0.01% to 1.00%.

Cr increases the equilibrium transformation temperature, and consequently Cr refines ferrite structure and pearlite structure; and thereby, Cr contributes to an increase of hardness (strength). At the same time, Cr strengthens cementite phase; and thereby, the hardness (strength) of pearlite structure is improved. However, in the case where the amount of Cr is less than 0.01%, such an effect becomes small, and the effect of improving the hardness of a rail steel is not observed at all. In the case where Cr is excessively added at an amount of more than 2.00%, hardenability is increased, and martensite structure is generated. Thereby, spalling damage starting from the martensite structure is liable to occur in the head corner portions and the head top portion; and as a result, resistance to surface damages is degraded. Therefore, the amount of Cr is limited to be in a range of 0.01% to 2.00%.

Mo, similarly to Cr, increases the equilibrium transformation temperature, and consequently Mo refines ferrite structure and pearlite structure; and thereby, Mo contributes to an increase of hardness (strength). Therefore, Mo is an element that improves hardness (strength). However, in the case where the amount of Mo is less than 0.01%, such an effect becomes small, and the effect of improving the hardness of rail steels is not observed at all. In the case where Mo is excessively added at an amount of more than 0.50%, transformation rate is remarkably degraded. Thereby, spalling damage starting from the martensite structure is liable to occur in the head corner portions and the head top portion; and as a result, resistance to surface damages is degraded. Therefore, the amount of Mo is limited to be in a range of 0.01% to 0.50%.

V refines austenite grains due to the pinning effect of V carbides and V nitrides in the case where a heat treatment is conducted at high temperatures. Furthermore, V increases the hardness (strength) of ferrite structure and pearlite structure due to the precipitation hardening of V carbides and V nitrides generated in the cooling process after hot rolling, and simultaneously, V improves toughness. V is an effective element to obtain these effects. In addition, in heat-affected portions that are reheated to a temperature in a range of Ac1 or less, V is an effective element to prevent the softening of welded joint heat-affected zones by generating V carbides and V nitrides in a relatively high temperature range. However, in the case where the amount of V is less than 0.005%, such an effect cannot be sufficiently expected, and the improvement in the hardness and the toughness of the ferrite structure and the pearlite structure is not observed. In the case where the amount of V exceeds 0.50%, the precipitation hardening of the carbides and nitrides of V becomes excessive, and the toughness of the ferrite structure and the pearlite structure is degraded. Thereby, spalling damage occurs in the head corner portions and the head top portion; and as a result, resistance to surface damages is degraded. Therefore, the amount of V is limited to be in a range of 0.005% to 0.50%.

Nb, similarly to V, refines austenite grains due to the pinning effect of Nb carbides and Nb nitrides in the case where a heat treatment is conducted at high temperatures. Furthermore, Nb increases the hardness (strength) of ferrite structure and pearlite structure due to the precipitation hardening of Nb carbides and Nb nitrides generated in the cooling process after hot rolling, and simultaneously, Nb improves toughness. Nb is an effective element to obtain these effects. In addition, in heat-affected portions that are reheated to a temperature in a range of Ac1 or less, Nb is an effective element to prevent the softening of welded joint heat-affected zones by stably generating the carbides of Nb and the nitrides of Nb from a low temperature range to a high temperature range. However, in the case where the amount of Nb is less than 0.002%, such an effect cannot be expected, and the improvement in the hardness and the toughness of the ferrite structure and the pearlite structure is not observed. In the case where the amount of Nb exceeds 0.050%, the precipitation hardening of the carbides and nitrides of Nb becomes excessive, and the toughness of ferrite structure and the pearlite structure is degraded. Thereby, spalling damage occurs in the head corner portions and the head top portion; and as a result, resistance to surface damages is degraded. Therefore, the amount of Nb is limited to be in a range of 0.002% to 0.050%.

B forms iron borocarbides ($Fe_{23}(CB)_6$) in austenite grain boundaries, and B accelerates pearlite transformation. This effect of accelerating pearlite transformation reduces the dependency of the pearlite transformation temperature on a cooling rate; and thereby, more uniform hardness distribution is achieved from the head surface portion to the inside portion of a rail. Therefore, it is possible to extend the usable period of the rail. In the case where the amount of B is less than 0.0001%, those effects are not sufficient, and improvement of the hardness distribution in the rail head portion is not observed. In the case where the amount of B exceeds 0.0050%, coarse iron borocarbides are generated; and thereby, toughness is degraded. Therefore, the amount of B is limited to be in a range of 0.0001% to 0.0050%.

Cu is an element that is solid-solubilized in a ferrite structure and in a ferrite phase in a pearlite structure, and Cu improves the hardness (strength) of the pearlite structure due to solid solution strengthening. In the case where the amount of Cu is less than 0.01%, those effects cannot be expected. In the case where the amount of Cu exceeds 1.00%, martensite structure, which is harmful to toughness, is generated by the remarkable improvement of hardenability. Thereby, spalling damage is liable to occur in the head corner portions and the head top portion; and as a result, resistance to surface damages is degraded. Therefore, the amount of Cu is limited to be in a range of 0.01% to 1.00%.

Ni is an element that improves toughness of a ferrite structure and a pearlite structure, and simultaneously, Ni increases hardness (strength) by solid solution strengthening. Furthermore, Ni finely precipitates intermetallic compound of $Ni_3Ti$, which is a complex compound with Ti, in weld heat-affected zones; and thereby, softening is suppressed by precipitation strengthening. In the case where the amount of Ni is less than 0.01%, those effects are extremely small. In the case where the amount of Ni exceeds 1.00%, toughness of a ferrite structure and a pearlite structure is remarkably degraded. Thereby, spalling damage is liable to occur in the head corner portions and the head top portion; and as a result, resistance to surface damages is degraded. Therefore, the amount of Ni is limited to be in a range of 0.01% to 1.00%.

Ti is an effective element that refines the structure of heat-affected zones which are heated to an austenite range by utilizing the fact that carbides of Ti and nitrides of Ti, which are precipitated during the reheating in welding, are not melted; and thereby, Ti prevents the embrittlement of welded joint portions. However, in the case where the amount of Ti is less than 0.0050%, those effects are small, and in the case where the amount of Ti exceeds 0.0500%, coarse carbides of Ti and nitrides of Ti are generated; and thereby, toughness of a rail is degraded. At the same time, fatigue damage occurs due to coarse precipitates. Therefore, the amount of Ti is limited to be in a range of 0.0050% to 0.050%.

Mg combines with O, S, Al or the like so as to form fine oxides; and thereby, Mg suppresses grain growth during the reheating in the hot-rolling of a rail, and Mg refines austenite grains. As a result, Mg improves the toughness of a ferrite structure and a pearlite structure. Mg is an effective element to obtain these effects. Furthermore, MgO and MgS finely disperse MnS; and thereby, Mn-diluted zones are formed around MnS. This contributes to the generation of ferrite transformation and pearlite transformation. As a result, since Mg mainly miniaturizes the sizes of pearlite blocks, Mg is an effective element for improving the toughness of a pearlite structure. However, in the case where the amount of Mg is less than 0.0005%, the effect is weak. In the case where the amount of Mg exceeds 0.0200%, coarse oxides of Mg are generated; and thereby, the toughness of a rail is degraded, and, at the same time, fatigue damage is caused by the coarse precipitates. Therefore, the added amount of Mg is limited to be in a range of 0.0005% to 0.0200%.

Since $ZrO_2$ inclusions have a good lattice consistency with γ-Fe, $ZrO_2$ inclusions acts as solidification nuclei in a high-carbon rail steel of which the primary crystal in a solidification process is γ-Fe; and thereby, the rate of equiaxial crystallization of solidified structures is increased. As a result, Zr is an element that suppresses the formation of segregation zones in the middle of a casting bloom and improves the properties of segregated portions. However, in the case where the amount of Zr is less than 0.0001%, the number (amount) of $ZrO_2$ inclusions is small; and thereby, $ZrO_2$ inclusions cannot sufficiently act as solidification nuclei. In addition, in the case where the amount of Zr exceeds 0.2000%, a large number (amount) of coarse Zr-based inclusions are generated; and thereby, toughness is degraded, and, at the same time, fatigue damage is caused by the coarse precipitates. Therefore, the added amount of Zr is limited to be in a range of 0.0001% to 0.2000%.

N segregates in austenite grain boundaries; and thereby, N accelerates ferrite transformation and pearlite transformation from the austenite grain boundaries. As a result, the size of pearlite blocks is mainly refined; and thereby, it is possible to improve toughness. N is an effective element to obtain these effects. However, in the case where the amount of N is less than 0.0060%, those effects are small. In the case where the amount of N exceeds 0.0200%, it becomes difficult to solid-solubilize N in a steel. As a result, air bubbles which act as the starting points of fatigue damage are generated; and thereby, fatigue damage occurs inside the rail head portion. Therefore, the amount of N is limited to be in a range of 0.0060% to 0.0200%.

(2) The Reasons why the Regions and Hardness of a Pearlite Structure in the Rail Head Surface Portion (Reference Signal: 3*a*) are Limited.

Next, the reasons why the head surface portion 3*a* of a rail includes a pearlite structure, and the hardness Hv thereof is limited to be in a range of 320 to 500 will be described.

Firstly, the reasons why the hardness Hv of a pearlite structure is limited to be in a range of 320 to 500 will be described.

In the present component system, in the case where the hardness Hv of the pearlite structure is less than 320, it becomes difficult to ensure the wear resistance of the head surface portion 3*a* of the rail; and thereby, the usable period of the rail is reduced. In addition, flaking damage occurs in the rolling contact surface due to plastic deformation; and thereby, the resistance to surface damages in the rail head surface portion 3*a* is greatly degraded. In addition, in the case where the hardness Hv of a pearlite structure exceeds 500, the toughness of the pearlite structure is greatly degraded; and thereby, the damage resistance in the rail head surface portion 3*a* is degraded. Therefore, the hardness Hv of the pearlite structure is limited to be in a range of 320 to 500.

Next, the reason why a range necessary to include a pearlite structure having a hardness Hv in a range of 320 to 500 is limited to the head surface portion 3*a* of a rail steel will be described.

Here, the head surface portion 3*a* of a rail refers to, as shown in FIG. 1, a portion ranging from surfaces of the head corner portions 2 and the head top portion 1 to a depth of 10 mm (solid line area). If a pearlite structure having the above-described components is disposed in the head surface portion 3*a*, wear due to the contact with wheels is suppressed; and thereby, the wear resistance of the rail is improved.

In addition, it is preferable to dispose a pearlite structure having a hardness Hv in a range of 320 to 500 in a portion 3*b* ranging from the surfaces of the head corner portions 2 and the head top portion 1 to a depth of 20 mm, that is, at least in the dotted line area in FIG. 1. Thereby, wear resistance is further ensured even in the case where wear occurs in the deeper inside of the rail head portion due to the contact with wheels; and thereby, the usable period of rails is improved.

Therefore, it is preferable to dispose a pearlite structure having a hardness Hv in a range of 320 to 500 at or in the vicinity of the surface of the rail head portion 3, with which the wheels mainly contact, and other portions may be a metallographic structure other than the pearlite structure.

Meanwhile, with regard to a method to obtain a pearlite structure having a hardness Hv in a range of 320 to 500 in the rail head portion, as described below, it is preferable to conduct an accelerated cooling on a rail head portion 3 with an austenite region in a high-temperature state after hot rolling or reheating.

Among the rail head portion 3 in the present invention, it is preferable that the metallographic structure in the head surface portion 3*a* or in the portion 3*b* which ranging to a depth of 20 mm and including the head surface portion 3*a* consists of the above-described pearlite structure. However, depending on the component compositions of a rail and the conditions of heat treatments and manufacturing methods, there are cases in which the pearlite structure is mixed with proeutectoid ferrite structure, proeutectoid cementite structure, bainite structure and martensite structure at a small amount, for example, an area ratio of 5% or less. Even in the case where the above-described structures are contained at a content of 5% or less, these structures do not have a major adverse affect on the wear resistance and the toughness of the rail head portion 3. Therefore, the above-described pearlite structure may include structures mixed with proeutectoid ferrite structure, proeutectoid cementite structure, bainite structure, martensite structure or the like at an area ratio of 5% or less.

In other words, among the rail head portion 3 in the present invention, 95% or more of the metallographic structure in the head surface portion 3*a* or the portion 3*b* ranging to a depth of 20 mm and including the head surface portion 3*a* needs to be a pearlite structure, and it is preferable that 98% or more of the metallographic structure in the rail head portion 3 be a pearlite structure in order to sufficiently ensure wear resistance and toughness.

Meanwhile, in the columns of 'Microstructure' in Tables 1 and 2 below, the description 'small amount' refers to a content of 5% or less, and structures other than a pearlite without the description 'small amount' mean that the structures are included at an amount of more than 5% (out of the range of the present invention).

(3) The Reasons why the Average Value of the Ratios (L/D) of the Long Side Lengths (L) to the Short Side Lengths (D) of Mn Sulfide-Based Inclusions are Limited In the present invention, the average value of the ratios (L/D) of the long side lengths (L) to the short side lengths (D) of Mn sulfide-based inclusions observed in an arbitrary cross-section taken along the longitudinal direction of the pearlite structure (a cross-section parallel to the length direction of a rail) is preferably in a range of 5.0 or lower (the feature of Claim 2).

The reasons why the average value of the ratios (L/D) of the long side lengths (L) to the short side lengths (D) of Mn sulfide-based inclusions observed in an arbitrary cross-section taken along the longitudinal direction is limited to the above range will be described in detail.

In the case where the average value of the ratios (L/D) of the long side lengths (L) to the short side lengths (D) of Mn sulfide-based inclusions in the longitudinal direction exceeds 5.0, Mn sulfide-based inclusions become large; and thereby, stress concentration occurs around the Mn sulfide-based inclusions. As a result, damage becomes liable to occur in the rail. Therefore, a remarkable improvement in impact values cannot be achieved in the mechanical test of the steel. Therefore, the average value of the ratios (L/D) of the long side lengths (L) to the short side lengths (D) of Mn sulfide-based inclusions is limited to be in a range of 5.0 or lower.

Meanwhile, the lower limit of the ratios (L/D) of the long side lengths (L) to the short side lengths (D) of Mn sulfide-based inclusions is not particularly limited; however, in the case where the long side length and the short side length of an inclusion are the same, that is, in the case where the inclusion has a circular outline, the length ratio (L/D) becomes 1.0, which becomes the substantial lower limit.

In addition, in order to further suppress the effect of large Mn sulfide-based inclusions that accelerate stress concentration, it is preferable to limit the value of the ratio (L/D) of the long side length (L) to the short side length (D) to be in a range of 4.0 or lower.

Here, a method of measuring the long side length (L) to the short side length (D) of a sulfide-based inclusion and a method of calculating the average value of the length ratios (L/D) will be described.

Figure 3:
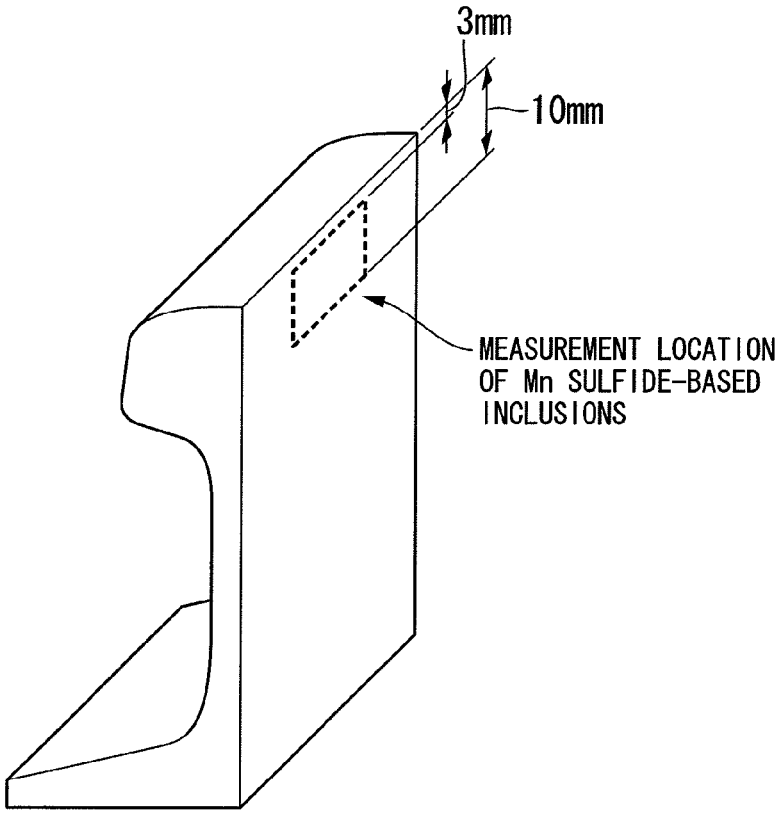
FIG. 3 is a view showing the observation location of Mn sulfide-based inclusions in the rail steel according to the present invention.

As shown in FIG. 3, samples are cut out from a cross-section in the longitudinal direction of the rail head portion where rail damage becomes obvious, and measurement of sulfide-based inclusions is performed. A cross-section of each of the cutout samples in the longitudinal direction of the rail is mirror-polished, and about 100 Mn sulfide-based inclusions are photographed using an optical microscope on an arbitrary cross-section. Then, the photos are scanned in an image processing apparatus so as to measure the long side lengths (L) and the short side lengths (D), and to obtain the length ratios (L/D); and thereafter, the average value of these values is calculated. The location where Mn sulfide-based inclusions are measured is not particularly limited; however, it is preferable to observe a portion ranging from the surface of the rail head portion, which acts as the starting point of damage, to a depth of 3 to 10 mm.

Meanwhile, as a method for controlling the average value of the ratios (L/D) of the long side lengths (L) to the short side lengths (D) of sulfide-based inclusions to be in a range of 5.0 or lower, it is necessary to efficiently and finely generate oxysulfides of REM ($REM_2O_2S$) which act as nuclei of sulfide-based inclusions. In order to control this, as described below, it is necessary to control the amount of oxygen in a molten steel before REM is added.

(4) The Reasons why the Number (Amount) (Per Unit Area) of Mn Sulfide-Based Inclusions Having Long Side Lengths (L) in a Range of 1 μm to 50 μm is Limited In the present invention, the number (per unit area) of Mn sulfide-based inclusions having long side lengths (L) in a range of 1 μm to 50 μm is preferably in a range of 10/mm$^2$ to 100/mm$^2$ (inclusions/mm$^2$) (the feature of Claim 3). In an arbitrary cross-section taken along the longitudinal direction (a cross-section parallel to the length direction of a rail), the reason why the long side length of Mn sulfide-based inclusions, which are evaluation objects, is limited to be in a range of 1 μm to 50 μm will be described in detail.

As a result of an investigation of the long side lengths of Mn sulfide-based inclusions and the actual damage performance of actual rails with regard to the present component system, it was confirmed that there was a good relationship between the number of Mn sulfide-based inclusions having long side lengths (L) in a range of 1 μm to 50 μm and the damage resistance of rails. Therefore, the long side length of Mn sulfide-based inclusions, which are evaluation objects, is limited to be in a range of 1 μm to 50 μm.

Next, the reasons why the number (amount) (per unit area) of Mn sulfide-based inclusions having long side lengths (L) in a range of 1 μm to 50 μm which are observed in an arbitrary cross-section in the longitudinal direction is limited to the above range in Claim 3 will be described in detail.

In the case where the total number (per unit area) of Mn sulfide-based inclusions having long side lengths (L) in a range of 1 μm to 50 μm exceeds 100/mm$^2$, the number of Mn sulfide-based inclusions becomes excessive and thereby, stress concentration occurs around the Mn sulfide-based inclusions. As a result, damage becomes liable to occur in the rail. Therefore, a further improvement in impact values cannot be achieved in the mechanical test of the steel. In addition, in the case where the total number (per unit area) of Mn sulfide-based inclusions having long side lengths (L) in the longitudinal direction in a range of 1 μm to 50 μm is less than 10/mm$^2$, trap sites that absorb inevitable hydrogen remaining in a steel are markedly decreased; and thereby, the possibility of inducing hydrogenous defects (hydrogen embrittlement) is increased. As a result, the damage resistance of the rail may be impaired. Therefore, the total number (per unit area) of Mn sulfide-based inclusions having long side lengths (L) in a range of 1 μm to 50 μm is limited to be in a range of 10/mm$^2$ to 100/mm$^2$.

In addition, in order to further reduce the effects of Mn sulfide-based inclusions which act as the starting points for fracture, and, at the same time, to suppress the hydrogenous defects in advance so as to stably improve fracture resistance of a rail, it is preferable to control the total number (per unit area) of Mn sulfide-based inclusions having long side lengths in a range of 1 μm to 50 μm to be in a range of 20/mm$^2$ to 85/mm$^2$.

Here, with regard to the number of inclusions, samples are taken by the method shown in FIG. 3. Mn sulfide-based inclusions are investigated using an optical microscope on an arbitrary cross-section in the longitudinal direction. Then, the number of inclusions having sizes in the above-described range is counted; and the number per unit area of a cross-section is calculated. It is preferable to perform observation in at least ten viewing fields and to use the average value as a representative value. The location where Mn sulfide-based inclusions are measured is not particularly limited; however, it is preferable to observe a portion ranging from the surface of the rail head portion, which acts as the starting point of damage, to a depth of 3 to 10 mm.

In addition, in order to control the number (per unit area) of Mn sulfide-based inclusions having long side lengths (L) of 1 μm to 50 μm to be in the above-described range, it is necessary to control the amount of S added to a molten steel to be in a range of 0.0100% or lower as limited above. Specifically, in ordinary secondary refining, it is preferable to add desulfurizing elements such as CaO, $Na_2CO_3$, $CaF_2$, or the like, or the desulfurizing elements together with Al, and then to perform refining. Meanwhile, the lower limit of the added amount of S is not particularly limited; however, it is preferable set the amount of S to be in a range of 0.0020% to 0.0080% to secure a minimum level of Mn sulfide-based inclusions for suppressing hydrogenous defects, and, at the same time, to improve toughness.

(5) Method for Manufacturing the Rail Steel According to the Present Invention

The method for manufacturing the rail steel including the above-described component composition and microstructure is not particularly limited; however, in general, the rail steel is manufactured by the following method.

At first, melting is conducted so as to obtain molten steel with a commonly used melting furnace such as a converter furnace, an electric furnace or the like. Then, REM is added to the molten steel, and oxysulfides of REM ($REM_2O_2S$) are uniformly dispersed so as to control the distribution of Mn sulfide-based inclusions. In addition, the added amount of S is reduced to a small value compared with the ordinary conditions. Thereafter, the molten steel is subjected to an ingot-making and blooming method or a continuous casting method so as to manufacture a steel ingot (a bloom). Then, the steel ingot is further subjected to hot rolling and subsequent heat treatments (reheating, cooling); and thereby, a rail is manufactured.

Particularly, in order to uniformly disperse fine oxysulfides of REM ($REM_2O_2S$), it is preferable to add Fe—Si-REM alloys or mischmetal containing REM (main components: Ce, La, Pr, and Nd) to a high-temperature molten steel ladle, a tundish during casting, or the like after ordinary refining. Furthermore, in order to prevent aggregation or segregation of oxysulfides of REM ($REM_2O_2S$) in a casting step, it is preferable to stir the molten metal during a solidification process using electromagnetic force or the like. In addition, in order to control the flow of the molten steel during casting, it is preferable to optimize the shape of a casting nozzle.

Conditions of manufacturing the steel ingot and conditions of subjecting the steel ingot to hot rolling which are the subsequent processes after the process of manufacturing the molten steel are not particularly limited, and ordinary conditions can be applied. The rail steel including the above-described components is melted in a generally-used melting furnace, such as a converter, an electric furnace, or the like, and a molten steel is subjected to an ingot-making and blooming method or a continuous casting method so as to manufacture a bloom for hot rolling.

The bloom is reheated to a temperature in a range of 1200° C. or higher, and then several passes of hot rolling are performed so as to mold the bloom into the form of a rail. The temperature where the final rolling is performed is preferably in a range of 900° C. to 1000° C. from the viewpoint of securing the shape and material properties.

In addition, with regard to the heat treatment after the hot rolling, it is preferable to conduct accelerated cooling on a rail head portion 3 at high temperatures with austenite regions after hot rolling or reheating in order to obtain a pearlite structure with a hardness Hv of 320 to 500 in the rail head portion 3. As the accelerated cooling method, by conducting the heat treatment (and cooling) with a method described in Patent Document 7 (Japanese Unexamined Patent Application, Publication No. H08-246100), Patent Document 8 (Japanese Unexamined Patent Application, Publication No. H09-111352) or the like, it is possible to obtain a structure and hardness in predetermined ranges.

Here, in order to conduct the heat treatment with reheating after the rolling of the rail, it is preferable to heat the rail head portion or the entire rail with a flame or induction heating.

Furthermore, as a method for controlling the average value of the ratios (L/D) of the long side lengths (L) to the short side lengths (D) of sulfide-based inclusions to be in a range of 5.0 or lower, it is necessary to efficiently and finely generate oxysulfides of REM ($REM_2O_2S$) that act as the nuclei of sulfide-based inclusions. In order to control this, it is necessary to control the amount of oxygen in the molten steel before REM is added. Specifically, it is preferable to perform deoxidization in advance with Al or Si so as to reduce the amount of oxygen to be in a range of 10 ppm or lower, and then to add REM. In the case where deoxidization is insufficient, oxysulfides ($REM_2O_2S$) are not generated, and $REM_2O_3$ that cannot act as the nuclei of sulfide-based inclusions is generated. Thereby, sulfide-based inclusions are not finely dispersed in the bloom before the rail hot rolling. As a result, in the rail after hot rolling, sulfide-based inclusions are elongated; and thereby, it becomes difficult to control the average value of the ratios (L/D) of the long side lengths (L) to the short side lengths (D) of sulfide-based inclusions to be in a range of 5.0 or lower.

EXAMPLES

Next, examples of the present invention will be described. Tables 1 to 3 show the chemical components of rail steels for tests (rail steels of the invention and rail steels of comparative examples)).

Meanwhile, in Tables, the chemical components #1 include the balance being iron and inevitable impurities. In addition, in Tables 1 and 2, the chemical components of which the amounts of S are not shown included S at contents in a range of more than 0.0100% to 0.0200%.

Rail steels having the component compositions shown in Tables 1 to 3 were manufactured in the following manner.

Melting was conducted with a commonly used melting furnace such as a converter furnace, an electric furnace or the like. As REM, mischmetal containing Ce, La, Pr, and Nd as the main components was added to molten metals, and oxysulfides of REM ($REM_2O_2S$) were uniformly dispersed so as to control the distribution of Mn sulfide-based inclusions. Thereafter, steel ingots were manufactured by an ingot-making and blooming method or a continuous casting method, and then, the steel ingots were subjected to hot rolling. After that, a heat treatment was performed so as to manufacture rails.

TABLE 1

| | | Chemical components (mass %) #1 | | | | | |
|---|---|---|---|---|---|---|---|
| Rail | Steel | C | Si | Mn | REM (Total amount of Ce, La, Pr, and Nd) | S | Ca/Al/Co/Cr/Mo/V/Nb/B/Cu/Ni/Ti/Mg/Zr/N |
| Rail steels of the invention | 1 | 0.65 | 0.25 | 0.80 | 0.0030 | — | Cu: 0.15 |
| | 2 | 1.20 | 0.25 | 0.80 | 0.0030 | — | Cu: 0.15 |
| | 3 | 0.85 | 0.05 | 0.60 | 0.0080 | — | |
| | 4 | 0.85 | 2.00 | 0.60 | 0.0080 | — | |
| | 5 | 0.90 | 0.30 | 0.05 | 0.0110 | — | Cr: 0.25 |
| | 6 | 0.90 | 0.30 | 2.00 | 0.0110 | — | Cr: 0.25 |
| | 7 | 1.10 | 0.50 | 0.70 | 0.0005 | — | |
| | 8 | 1.10 | 0.50 | 0.70 | 0.0500 | — | |
| | 9 | 0.65 | 0.30 | 0.75 | 0.0080 | — | |
| | 10 | 0.65 | 0.30 | 0.75 | 0.0080 | — | |
| | 11 | 0.65 | 0.30 | 0.75 | 0.0080 | 0.0080 | |
| | 12 | 0.70 | 0.30 | 0.75 | 0.0080 | 0.0050 | |
| | 13 | 0.70 | 1.25 | 0.20 | 0.0050 | — | Ni: 0.25 |
| | 14 | 0.75 | 0.50 | 1.00 | 0.0150 | — | Nb: 0.01 |
| | 15 | 0.75 | 0.50 | 1.00 | 0.0150 | — | Nb: 0.01 |
| | 16 | 0.75 | 0.50 | 1.00 | 0.0150 | 0.0020 | Nb: 0.01 |
| | 17 | 0.80 | 0.40 | 1.10 | 0.0010 | — | Ca: 0.0022 |
| | 18 | 0.80 | 0.40 | 1.10 | 0.0080 | — | Ca: 0.0022 |
| | 19 | 0.80 | 0.40 | 1.10 | 0.0160 | — | Ca: 0.0022 |
| | 20 | 0.85 | 0.55 | 0.85 | 0.0080 | — | |
| | 21 | 0.85 | 0.55 | 0.85 | 0.0080 | — | |
| | 22 | 0.85 | 0.55 | 0.85 | 0.0080 | 0.0050 | |

TABLE 2

| | | Chemical components (mass %) #1 | | | | | |
|---|---|---|---|---|---|---|---|
| Rail | Steel | C | Si | Mn | REM (Total amount of Ce, La, Pr, and Nd) | S | Ca/Al/Co/Cr/Mo/V/Nb/B/Cu/Ni/Ti/Mg/Zr/N |
| Rail steels of the invention | 23 | 0.90 | 0.30 | 1.25 | 0.0070 | 0.0060 | |
| | 24 | 0.90 | 0.30 | 1.25 | 0.0070 | 0.0060 | Co: 0.30 |
| | 25 | 0.95 | 0.95 | 0.80 | 0.0300 | — | Ti: 0.01 |
| | 26 | 0.95 | 0.95 | 0.80 | 0.0300 | — | Ti: 0.01 |
| | 27 | 0.95 | 0.95 | 0.80 | 0.0300 | 0.0030 | Ti: 0.01 |
| | 28 | 0.95 | 0.25 | 1.20 | 0.0100 | — | Mo: 0.02 |
| | 29 | 1.00 | 0.50 | 0.70 | 0.0050 | — | Cr: 0.20 |
| | 30 | 1.00 | 0.50 | 0.70 | 0.0100 | — | Cr: 0.20 |
| | 31 | 1.00 | 0.50 | 0.70 | 0.0220 | — | Cr: 0.20 |
| | 32 | 1.05 | 0.10 | 0.90 | 0.0100 | — | Al: 0.0080 |
| | 33 | 1.05 | 0.10 | 0.90 | 0.0100 | — | Al: 0.0080 |
| | 34 | 1.05 | 0.10 | 0.90 | 0.0100 | 0.0025 | Al: 0.0080 |
| | 35 | 1.05 | 0.85 | 0.80 | 0.0150 | 0.0080 | B: 0.0020<br>Ti: 0.01 |
| | 36 | 1.10 | 0.50 | 0.70 | 0.0020 | 0.0050 | Mg: 0.0020 |

TABLE 2-continued

| Rail | Steel | Chemical components (mass %) #1 C | Si | Mn | REM (Total amount of Ce, La, Pr, and Nd) | S | Ca/Al/Co/Cr/Mo/V/Nb/B/Cu/Ni/Ti/Mg/Zr/N |
|---|---|---|---|---|---|---|---|
| | 37 | 1.10 | 0.50 | 0.70 | 0.0100 | 0.0050 | Mg: 0.0020 |
| | 38 | 1.10 | 0.50 | 0.70 | 0.0300 | 0.0050 | Mg: 0.0020 |
| | 39 | 1.15 | 0.35 | 1.35 | 0.0200 | — | Zr: 0.0020 |
| | 40 | 1.15 | 0.95 | 0.90 | 0.0085 | 0.0090 | V: 0.02 |
| | 41 | 1.20 | 1.25 | 0.45 | 0.0250 | — | N: 0.0080 |
| | 42 | 1.20 | 1.25 | 0.45 | 0.0250 | — | N: 0.0080 |
| | 43 | 1.20 | 1.25 | 0.45 | 0.0250 | 0.0050 | N: 0.0080 |

TABLE 3

| Rail | Steel | Chemical components (mass %) #1 C | Si | Mn | REM (Total amount of Ce, La, Pr, and Nd) | S | Ca/Al/Co/Cr/Mo/V/Nb/B/Cu/Ni/Ti/Mg/Zr/N |
|---|---|---|---|---|---|---|---|
| Rail steels of comparative examples | 44 | 0.60 | 0.25 | 0.80 | 0.0030 | — | Cu: 0.15 |
| | 45 | 1.30 | 0.25 | 0.80 | 0.0030 | — | Cu: 0.15 |
| | 46 | 0.85 | 0.01 | 0.60 | 0.0080 | — | |
| | 47 | 0.85 | 2.50 | 0.60 | 0.0080 | — | |
| | 48 | 0.90 | 0.30 | 0.01 | 0.0110 | — | Cr: 0.25 |
| | 49 | 0.90 | 0.30 | 2.30 | 0.0110 | — | Cr: 0.25 |
| | 50 | 1.10 | 0.50 | 0.70 | 0.0001 | — | |
| | 51 | 1.10 | 0.50 | 0.70 | 0.0600 | — | |
| | 52 | 0.65 | 0.30 | 0.75 | 0.0002 | — | |
| | 53 | 0.65 | 0.30 | 0.75 | 0.0700 | — | |
| | 54 | 0.75 | 0.50 | 1.00 | 0.0004 | — | Nb: 0.01 |
| | 55 | 0.85 | 0.55 | 0.85 | 0.0002 | — | |
| | 56 | 0.85 | 0.55 | 0.85 | 0.0700 | — | |
| | 57 | 0.95 | 0.95 | 0.80 | 0.0001 | — | Ti: 0.01 |
| | 58 | 0.95 | 0.95 | 0.80 | 0.0600 | — | Ti: 0.01 |
| | 59 | 1.05 | 0.10 | 0.90 | 0.0004 | | Al: 0.0080 |
| | 60 | 1.20 | 1.25 | 0.45 | 0.0003 | — | N: 0.0080 |
| | 61 | 1.20 | 1.25 | 0.45 | 0.0600 | — | N: 0.0080 |
| | 62 | 0.65 | 0.30 | 0.45 | 0.0080 | — | |
| | 63 | 1.20 | 0.50 | 0.45 | 0.0250 | — | N: 0.0080 |
| | 64 | 0.95 | 1.20 | 1.20 | 0.0300 | — | Ti: 0.01 |
| | 65 | 0.85 | 0.30 | 0.30 | 0.0080 | — | |
| | 66 | 1.05 | 1.00 | 1.35 | 0.0100 | — | Al: 0.0090 |

In accordance with the above-described method, the ratios (L/D) of the long side lengths (L) to the short side lengths (D) of Mn sulfide-based inclusions and the number (per unit area) of Mn sulfide-based inclusions having long side lengths (L) in a range of 1 μM to 50 μm were measured.

In addition, the microstructures and hardness of the rail head portions were measured in the following manner.

A sample was cut off from a rail head surface portion including a head surface portion 3*a*. Thereafter, a surface to be observed was polished, and then the surface was etched with nital etching fluid. The microstructure in the surface to be observed was observed using an optical microscope in accordance with JIS G 0551. In addition, in accordance with JIS B7774, the Vickers hardness Hv of the cut-off sample was measured. Here, the Vickers hardness was measured while a diamond indenter was loaded on the sample at a load of 98 N (10 kgf). The Vickers hardness is expressed as (Hv, 98N) in Tables.

Meanwhile, the observation of microstructures and the measurement of hardness were performed at a depth of 4 mm from the surface of the rail head surface portion.

Wear Test of Head Portion

Figure 4:
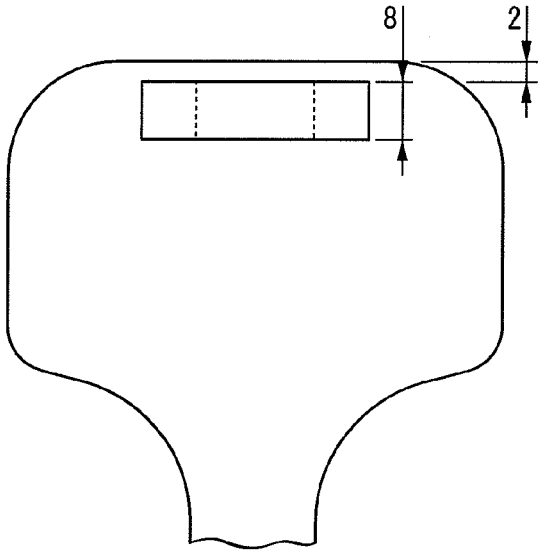
FIG. 4 is a view showing the location where the specimens are taken for the wear test shown in Tables 4 to 9.

FIG. 4 shows a location from which a test specimen for the wear test was taken, and the numeric values in the drawing indicate dimensions (mm). As shown in FIG. 4, a disk-like test specimen was cut off from a portion including the head surface portion in the rail steel.

Figure 5:
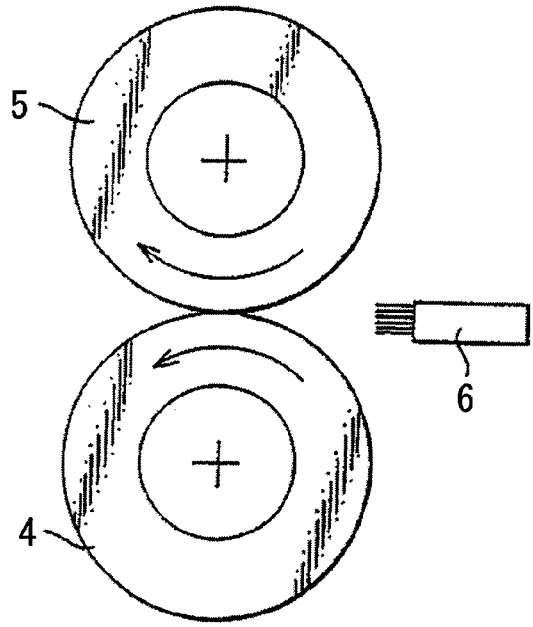
FIG. 5 is a view showing the outline of the wear test shown in Tables 4 to 9.

Then, as shown in FIG. 5, two opposing rotation axes were prepared, the disk-like test specimen (rail test specimen 4) was disposed at one of the rotation axis, and an opponent material 5 was disposed at the other rotation axis. The rail test specimen 4 and the opponent material 5 were brought into contact in a state where a predetermined load was applied to the rail test specimen 4. In such a state, the two rotation axes were rotated at a predetermined speed while supplying a compressed air from a cooling nozzle 6 so as to cool the test specimen. Then, after rotating the axes 700,000 times, the reduced amount (abraded amount) of the weight of the rail test specimen 4 was measured.

The conditions for the wear test of the head portion are shown below.

Testing machine. Nishihara-type wear testing machine (refer to FIG. 5)

Shape of test specimen: Disk-like test specimen (outer diameter: 30 mm, thickness: 8 mm)

Location from which the test specimen was taken: 2 mm below the surface of the rail head portion (refer to FIG. 4)

Test load: 686 N (contact surface pressure 640 MPa)

Sliding ratio: 20%

Opponent material: pearlite steel (Hv 380)

Atmosphere: in the atmosphere (air)

Cooling: Forcible cooling by a compressed air (flow rate: 100 l/min)

Number of repetitions: 700,000

Impact Test of Head Portion

Figure 6:
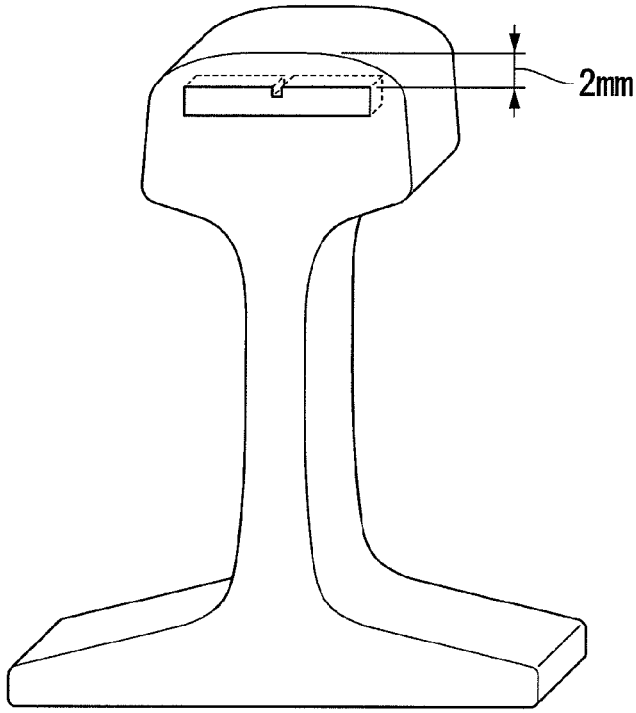
FIG. 6 is a view showing the location where the specimens are taken for the impact test shown in Tables 4 to 9.

FIG. 6 shows a location from which a test specimen for the impact test was taken. As shown in FIG. 6, a test specimen was cut off along the rail width direction (transverse cross-section) in the transverse cross-section of the rail steel so that a portion including the head surface portion forms the bottom of a notch.

Then, the obtained test specimen was subjected to an impact test under the following conditions; and thereby, impact values (J/cm$^2$) were measured.

Testing machine: Impact testing machine

Shape of test specimen: 2 mm U notch in JIS No. 3

Location from which the test specimen is taken: 2 mm below the surface of the rail head portion (refer to FIG. 6)

Testing temperature: normal temperature (20° C.)

The obtained results are shown in Tables 4 to 9.

Meanwhile, in Tables, the microstructures and hardness of the materials of the head portion with a sign of *1 are data measured at a depth of 4 mm from the surface of the head portion. The results of the wear tests with a sign of *2 are the results of the above-described wear tests, and the wear tests were performed by the method shown in FIG. 5 under the above-described conditions after the test specimens were taken from the location shown in FIG. 4. The impact test results with a sign of *3 are the results of the above-described impact tests, and the impact tests were performed under the above-described conditions after the test specimens were taken from the location shown in FIG. 6.

TABLE 4

| Rail | Steel | Average value of the long side lengths (L)/the short side lengths (D) of Mn sulfide-based inclusions | Number of Mn sulfide-based inclusions having long side lengths (L) in a range of 1 μm to 50 μm (inclusions/mm$^2$) | Material of head portion *1 Microstructure | Material of head portion *1 Hardness (Hv, 98N) | Wear test results *2 (g, 700 thousand times) | Impact test results *3 Impact values (J/cm$^2$) |
|---|---|---|---|---|---|---|---|
| Rail steels of the invention | 1 | — | — | pearlite + small amount of proeutectic ferrite | 320 | 1.45 | 35.0 |
| | 2 | — | — | pearlite + small amount of proeutectic cementite | 400 | 0.35 | 9.0 |
| | 3 | — | — | pearlite | 330 | 1.25 | 16.0 |
| | 4 | — | — | pearlite + small amount of martensite | 460 | 1.10 | 15.5 |
| | 5 | — | | pearlite | 320 | 1.00 | 15.0 |
| | 6 | — | — | pearlite + small amount of martensite | 460 | 0.91 | 14.5 |
| | 7 | — | — | pearlite | 420 | 0.46 | 11.5 |
| | 8 | — | — | pearlite | 420 | 0.45 | 13.0 |
| | 9 | — | — | pearlite | 350 | 1.35 | 33.0 |
| | 10 | 3.5 | — | pearlite | 350 | 1.33 | 35.0 |
| | 11 | 3.4 | 85 | pearlite | 350 | 1.37 | 37.5 |

TABLE 5

| Rail | Steel | Average value of the long side lengths (L)/the short side lengths (D) of Mn sulfide-based inclusions | Number of Mn sulfide-based inclusions having long side lengths (L) in a range of 1 μm to 50 μm (inclusions/mm$^2$) | Material of head portion *1 Microstructure | Material of head portion *1 Hardness (Hv, 98N) | Wear test results *2 (g, 700 thousand times) | Impact test results *3 Impact values (J/cm$^2$) |
|---|---|---|---|---|---|---|---|
| Rail steels of the invention | 12 | 3.4 | 45 | pearlite | 350 | 1.25 | 30.0 |
| | 13 | 4.0 | — | pearlite | 370 | 1.22 | 28.0 |
| | 14 | — | — | pearlite + small amount of bainite | 390 | 1.18 | 25.0 |
| | 15 | 2.5 | — | pearlite + small amount of bainite | 390 | 1.19 | 27.0 |
| | 16 | 2.4 | 20 | pearlite + small amount of bainite | 390 | 1.18 | 29.5 |
| | 17 | — | | pearlite | 400 | 1.05 | 20.5 |
| | 18 | — | — | pearlite | 400 | 1.04 | 21.5 |
| | 19 | — | — | pearlite | 400 | 1.06 | 23.5 |
| | 20 | — | — | pearlite | 400 | 0.95 | 16.5 |
| | 21 | 3.4 | — | pearlite | 400 | 0.94 | 18.0 |
| | 22 | 3.4 | 50 | pearlite | 400 | 0.94 | 21.0 |

TABLE 6

| Rail | Steel | Average value of the long side lengths (L)/the short side lengths (D) of Mn sulfide-based inclusions | Number of Mn sulfide-based inclusions having long side lengths (L) in a range of 1 μm to 50 μm (inclusions/mm$^2$) | Material of head portion *1 Microstructure | Material of head portion *1 Hardness (Hv, 98N) | Wear test results *2 (g, 700 thousand times) | Impact test results *3 Impact values (J/cm$^2$) |
|---|---|---|---|---|---|---|---|
| Rail steels of the invention | 23 | 3.8 | 65 | pearlite | 420 | 0.86 | 16.0 |
| | 24 | 3.8 | 65 | pearlite | 420 | 0.70 | 16.5 |
| | 25 | — | — | pearlite | 430 | 0.75 | 12.0 |
| | 26 | 1.3 | — | pearlite | 430 | 0.74 | 14.0 |
| | 27 | 1.3 | 35 | pearlite | 430 | 0.75 | 16.0 |
| | 28 | 3.0 | — | pearlite + small amount of martensite | 450 | 0.72 | 12.3 |
| | 29 | 4.0 | — | pearlite | 425 | 0.60 | 12.0 |
| | 30 | 3.0 | — | pearlite | 425 | 0.62 | 13.0 |
| | 31 | 1.5 | — | pearlite | 425 | 0.60 | 14.0 |
| | 32 | — | — | pearlite | 375 | 0.64 | 11.0 |
| | 33 | 2.8 | — | pearlite | 375 | 0.63 | 12.5 |

TABLE 7

| Rail | Steel | Average value of the long side lengths (L)/the short side lengths (D) of Mn sulfide-based inclusions | Number of Mn sulfide-based inclusions having long side lengths (L) in a range of 1 μm to 50 μm (inclusions/mm$^2$) | Material of head portion *1 Microstructure | Material of head portion *1 Hardness (Hv, 98N) | Wear test results *2 (g, 700 thousand times) | Impact test results *3 Impact values (J/cm$^2$) |
|---|---|---|---|---|---|---|---|
| Rail steels of the invention | 34 | 2.8 | 26 | pearlite | 375 | 0.63 | 14.0 |
| | 35 | 2.5 | 82 | pearlite | 460 | 0.45 | 12.0 |
| | 36 | 4.8 | 55 | pearlite | 445 | 0.44 | 10.5 |
| | 37 | 3.1 | 50 | pearlite | 445 | 0.43 | 11.5 |
| | 38 | 1.2 | 40 | pearlite | 445 | 0.44 | 13.0 |
| | 39 | 1.8 | — | pearlite + small amount of proeutectic cementite | 500 | 0.30 | 9.0 |
| | 40 | 3.4 | 85 | pearlite | 450 | 0.32 | 10.0 |
| | 41 | — | — | pearlite + small amount of proeutectic cementite | 445 | 0.25 | 9.0 |
| | 42 | 1.5 | | pearlite + small amount of proeutectic cementite | 445 | 0.26 | 10.0 |
| | 43 | 1.5 | 50 | pearlite + small amount of proeutectic cementite | 445 | 0.27 | 11.0 |

TABLE 8

| Rail | Steel | Average value of the long side lengths (L)/the short side lengths (D) of Mn sulfide-based inclusions | Number of Mn sulfide-based inclusions having long side lengths (L) in a range of 1 μm to 50 μm (inclusions/mm$^2$) | Material of head portion *1 Microstructure | Material of head portion *1 Hardness (Hv, 98N) | Wear test results *2 (g, 700 thousand times) | Impact test results *3 Impact values (J/cm$^2$) |
|---|---|---|---|---|---|---|---|
| Rail steels of comparative examples | 44 | — | — | pearlite + proeutectic ferrite | 300 | 2.15 (greatly worn) | 36.5 |
| | 45 | | — | pearlite + proeutectic comentite | 420 | 0.30 | 5.0 (impact value lowered) |
| | 46 | — | — | pearlite | 310 | 1.65 (greatly worn) | 17.5 |
| | 47 | — | — | pearlite + martensite | 550 | 1.80 (greatly worn) | 4.5 (impact value lowered) |
| | 48 | — | — | pearlite | 280 | 1.62 (greatly worn) | 15.2 |
| | 49 | — | — | pearlite + martensite | 580 | 1.90 (greatly worn) | 4.0 (impact value lowered) |
| | 50 | — | — | pearlite | 440 | 0.48 | 8.0 |
| | 51 | — | — | pearlite | 440 | 0.48 | 7.5 |
| | 52 | — | — | pearlite | 350 | 1.35 | 27.0 |
| | 53 | — | — | pearlite | 350 | 1.35 | 25.0 |
| | 54 | — | — | pearlite + small amount of bainite | 390 | 1.18 | 21.0 |

TABLE 9

| Rail | Steel | Average value of the long side lengths (L)/the short side lengths (D) of Mn sulfide-based inclusions | Number of Mn sulfide-based inclusions having long side lengths (L) in a range of 1 μm to 50 μm (inclusions/mm$^2$) | Material of head portion *1 Microstructure | Material of head portion *1 Hardness (Hv, 98N) | Wear test results *2 (g, 700 thousand times) | Impact test results *3 Impact values (J/cm$^2$) |
|---|---|---|---|---|---|---|---|
| Rail steels of comparative examples | 55 | — | — | pearlite | 400 | 0.95 | 13.0 |
| | 56 | — | — | pearlite | 400 | 0.95 | 12.0 |
| | 57 | — | — | pearlite | 430 | 0.75 | 9.5 |
| | 58 | — | — | pearlite | 430 | 0.75 | 8.0 |
| | 59 | — | — | pearlite | 375 | 0.64 | 8.5 |
| | 60 | — | — | pearlite + small amount of proeutectic cementite | 445 | 0.25 | 7.0 |
| | 61 | — | — | pearlite + small amount of proeutectic cementite | 445 | 0.25 | 6.0 |

TABLE 9-continued

| Rail | Steel | Average value of the long side lengths (L)/the short side lengths (D) of Mn sulfide-based inclusions | Number of Mn sulfide-based inclusions having long side lengths (L) in a range of 1 μm to 50 μm (inclusions/mm$^2$) | Material of head portion *1 Microstructure | Hardness (Hv, 98N) | Wear test results *2 (g, 700 thousand times) | Impact test results *3 Impact values (J/cm$^2$) |
|---|---|---|---|---|---|---|---|
| | 62 | | | pearlite + proeutectic ferrite | 320 | 2.15 (greatly worn) | 35.0 |
| | 63 | — | — | pearlite + proeutectic cementite | 370 | 0.40 | 5.0 (impact value lowered) |
| | 64 | — | — | pearlite + martensite | 490 | 1.90 (greatly worn) | 4.0 (impact value lowered) |
| | 65 | — | — | pearlite | 300 | 1.75 (greatly worn) | 15.0 |
| | 66 | — | — | pearlite | 520 | 0.40 | 6.0 (impact value lowered) |

(1) Rails of the Invention (43 Rails), Steel Nos. 1 to 43

Steel Nos. 1 to 9, 14, 17 to 20, 32, and 41: pearlitic rails which have chemical components within the limited ranges of the present invention and microstructures and hardness of rail head portions within the limited ranges of the present invention Steel Nos. 10, 13, 15, 21, 26, 28 to 31, 33, 39, and 42: pearlitic rails which have chemical components within the limited ranges of the present invention, ratios (L/D) of the long side lengths (L) to the short side lengths (D) of Mn sulfide-based inclusions within the limited range of the present invention, and microstructures and hardness of rail head portions within the limited ranges of the present invention Steel Nos. 11, 12, 16, 22 to 24, 27, 34 to 38, 40, and 43: pearlitic rails which have chemical components within the limited ranges of the present invention, ratios (L/D) of the long side lengths (L) to the short side lengths (D) of Mn sulfide-based inclusions within the limited range of the present invention, added amounts of S within the limited range of the present invention, numbers (per unit area) of Mn sulfide-based inclusions having long side lengths (L) in a range of 1 μm to 50 μm within the limited range of the present invention, and the microstructure and hardness of the rail head portion within the limited ranges of the present invention Here, among the rails of the invention, in rails including a small amount of proeutectoid ferrite, a small amount of proeutectoid cementite, a small amount of bainite, or a small amount of martensite in the microstructures, the ratios of these small amounts of structures other than a pearlite structure were 5% or lower.

(2) Rails of Comparative Examples (23 Rails), Steel Nos. 44 to 66

Steels No. 44 to 49: rails of which the amounts of C, Si, and Mn are outside the ranges of the invention Steels No. 50 to 61: rails of which the amounts of REM are outside the range of the invention Steels No. 62 to 64: rails of which the amounts of chemical components are within the ranges of the present invention; however, the microstructures of the head portions do not fulfill the above-described features of the present invention.

Steels No. 65 to 66: rails of which the amounts of chemical components are within the ranges of the present invention; however, the hardness of the head portions is outside the limited range of the present invention Here, among the rails of comparative examples, in rails including proeutectoid ferrite, proeutectoid cementite, or martensite in the microstructures, the ratios of these small amounts of structures other than a pearlite structure were more than 5%. In rails including a small amount of proeutectoid cementite or a small amount of bainite, the ratios of these small amounts of structures were 5% or lower.

As shown in Tables 1 to 9, in comparison to the rail steels of comparative examples (steel Nos. 44 to 49), the rail steels of the invention (steel Nos. 1 to 43) includes the chemical components of C, Si, and Mn at amounts within the limited ranges of the present invention. Therefore, it was possible to stably obtain a pearlite structure having hardness within the limited range of the present invention without generating eutectoid ferrite structure, eutectoid cementite structure and martensite structure, which adversely affect the wear resistance and the toughness.

As shown in Tables 1 to 9, in comparison to the rail steels of comparative examples (steel Nos. 62 to 66), the rail steels of the invention (steel Nos. 1 to 43) included pearlite structures in the microstructures of the head portions, and the hardness of the pearlite structures was within the limited range of the present invention. As a result, it was possible to improve the wear resistance and the toughness of the rails.

Figure 7:
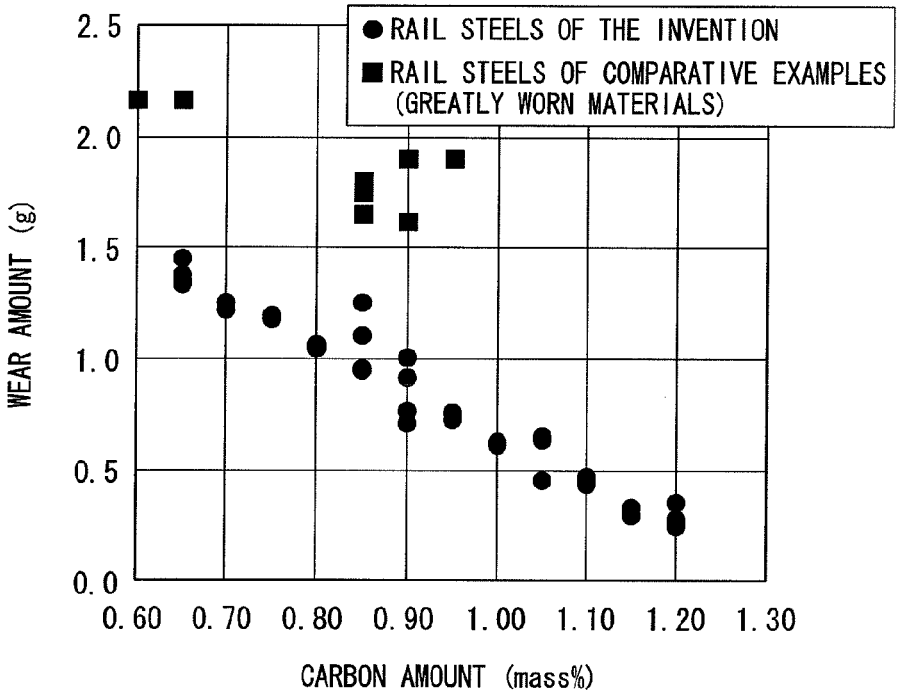
FIG. 7 is a view showing the relationship between the amount of carbon and the amount of wear in the results of the wear test of the rail steels according to the present invention (Steel Nos. 1 to 43) and rail steels of comparative examples (Steel Nos. 44, 46, 47, 48, 49, 62, 64, and 65).

FIG. 7 shows the results of the wear test of the rail steels of the invention (steel Nos. 1 to 43) and the rail steels of comparative examples (steel Nos. 44, 46, 47, 48, 49, 62, 64, and 65). In the case where C, Si and Mn were included at amounts within the limited ranges of the present invention, the generation of eutectoid ferrite structure and martensite structure, which adversely affect the wear resistance, was prevented, and in addition, the hardness was within the limited range of the present invention, it was possible to greatly improve the wear resistance with any amount of carbon.

Figure 8:
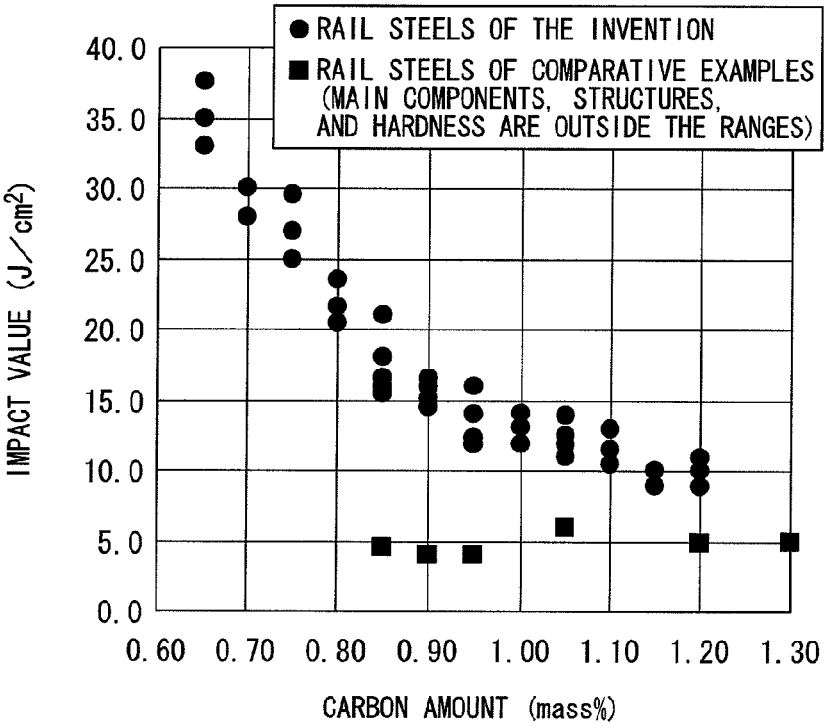
FIG. 8 is a view showing the relationship between the amount of carbon and the impact value in the results of the impact test of rail steels according to the present invention (Steel Nos. 1 to 43) and rail steels of comparative examples (Steel Nos. 45, 47, 49, 63, 64, and 66).

FIG. 8 shows the results of the impact test of the rail steels of the invention (steel Nos. 1 to 43) and the rail steels of comparative examples (steel Nos. 45, 47, 49, 63, 64, and 66). In the case where C, Si and Mn were included at amounts within the limited ranges of the present invention, the generation of eutectoid cementite structure and martensite structure, which adversely affect the toughness, was prevented, and in addition, the hardness was within the limited range of the present invention, it was possible to greatly improve the toughness with any amount of carbon.

Figure 9:
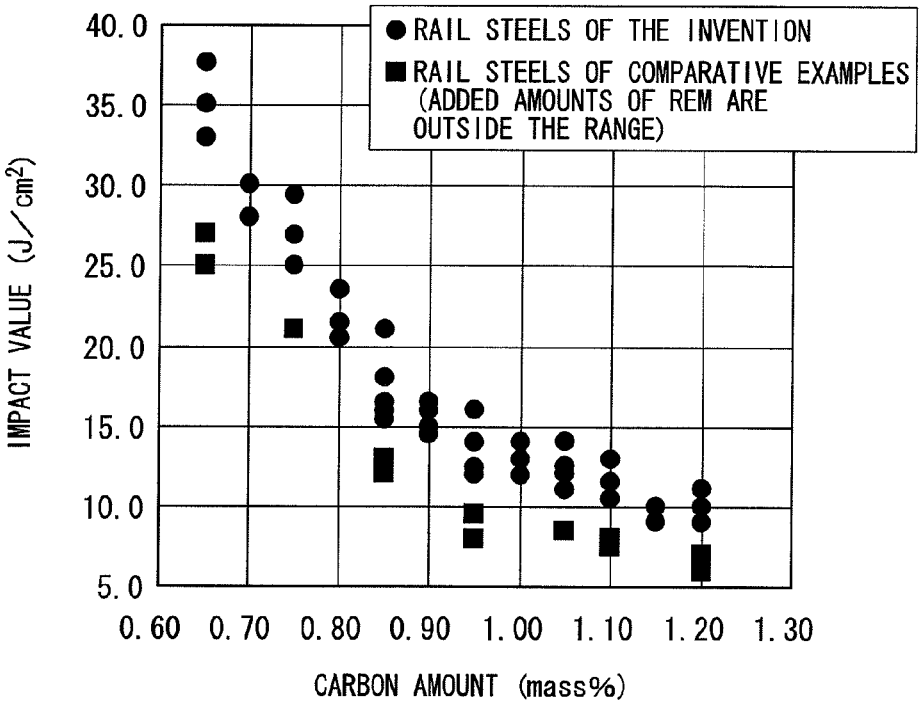
FIG. 9 is a view showing the relationship between the amount of carbon and the impact value in the results of the impact test of rail steels according to the present invention and rail steels of comparative examples (Steel Nos. 50 to 61, and rails in which added amounts of REM are outside the limited range), which are shown in Tables 1 to 3.

As shown in Tables 1 to 9 and FIG. 9, in comparison to the rail steels of comparative examples (steel Nos. 50 to 61), the rail steels of the invention (steel Nos. 1 to 43) included REM at amounts within the range of the present invention; and thereby, it was possible to greatly improve the toughness of the pearlitic rail with any amount of carbon.

Figure 10:
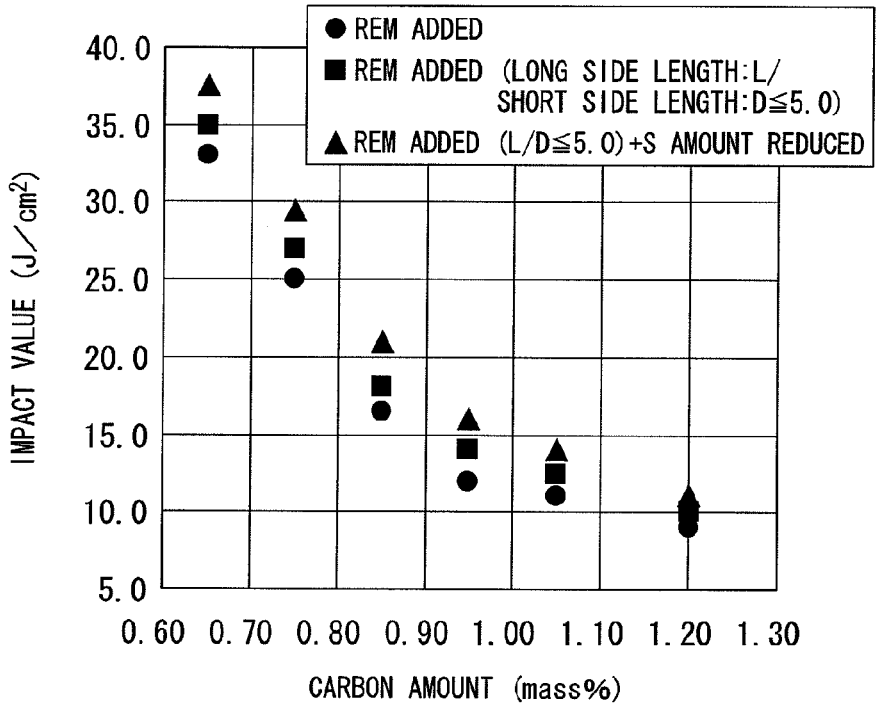
FIG. 10 is a view showing the relationship between the amount of carbon and the impact value in the results of the impact test of rail steels according to the present invention (Steel Nos. 9 to 11, 14 to 16, 20 to 22, 25 to 27, 32 to 34, and 41 to 43), which are shown in Tables 1 to 3.

Furthermore, as shown in Tables 1 to 9 and FIG. 10, with regard to the rail steels of the invention (steel Nos. 9 to 11, 14 to 16, 20 to 22, 25 to 27, 32 to 34, and 41 to 43), during the manufacture of the molten steels of rails, the oxygen amounts at the time when REM was added in a converter were controlled by pre-deoxidization, and, furthermore, the added amounts of REM were set to be in the range of the present invention. Thereby, the ratios (L/D) of the long side lengths (L) to the short side lengths (D) of Mn sulfide-based inclusions were controlled to be in the range of the present invention. As a result, it was possible to improve the toughness of the pearlitic rails. In addition to the above, by reducing the added amount of S and setting the number of Mn sulfide-based inclusions having long side lengths (L) in a range of 1 μm to 50 μm to be in the range of the present invention, it was possible to further improve the toughness of the pearlitic rail.

INDUSTRIAL APPLICABILITY

The pearlitic rail according to the present invention has wear resistance and toughness superior to those of a high-strength rail in current use. Therefore, the present invention can be preferably applied to rails used in an extremely severe track environment, such as rails for freight railways that transport natural resources mined from regions with severe natural environments.

BRIEF DESCRIPTION OF REFERENCE SIGNS

1: head top portion, 2: head corner portion, 3: rail head portion, 3*a*: head surface portion, 3*b*: a portion ranging from surfaces of head corner portions and a head top portion to a depth of 20 mm, 4: rail test specimen, 5: opposing material, and 6: nozzle for cooling.

The invention claimed is:

1. A pearlitic rail comprising a steel consisting of: in terms of percent by mass, C: 0.65% to 1.20%;

Si: 0.05% to 2.00%;

Mn: 0.05% to 2.00%; and

REM: 0.0005% to 0.0500%, with the balance being Fe and inevitable impurities, wherein, in 95% or more of a metallographic structure contained in a head surface portion which ranges from surfaces of head corner portions and a head top portion to a depth of 10 mm in a head portion of the rail or in a portion which ranges from the surfaces of the head corner portions and the head top portion to a depth of 20 mm in the head portion is a pearlite structure, the hardness Hv of the head surface portion is in a range of 320 to 500, and an average value of ratios (L/D) of long side lengths (L) to short side lengths (D) of Mn sulfide-based inclusions observed in an arbitrary cross-section taken from a portion ranging from the surface of the head top portion to a depth of 3 mm to 10 mm along a longitudinal direction of the pearlite structure is in a range of 5.0 or lower.

2. The pearlitic rail according to claim 1, wherein Mn sulfide-based inclusions having long side lengths (L) in a range of 1 μm to 50 μm are present at an amount per unit area in a range of $10/mm^2$ to $100/mm^2$ in an arbitrary cross-section taken along the longitudinal direction of the pearlite structure.

3. A pearlitic rail comprising a steel composition consisting of: in terms of percent by mass, C: 0.65% to 1.20%;

Si: 0.05% to 2.00%;

Mn: 0.05% to 2.00%;

REM: 0.0005% to 0.0500%, and one or more selected from S: 0.0020% to 0.0200%, Ca: 0.0005% to 0.0150%, Al: 0.0040% to 0.50%, Co: 0.01% to 1.00%, Cr: 0.01% to 2.00%, Mo: 0.01% to 0.50%, Nb: 0.002% to 0.050%, B: 0.0001% to 0.0050%, Ni: 0.01% to 1.00%, Ti: 0.0050% to 0.0500%, Mg: 0.0005% to 0.0200%, Zr: 0.0001% to 0.2000%, and N: 0.0060% to 0.0200%, with the balance being Fe and inevitable impurities, wherein in 95% or more of a metallographic structure contained in a head surface portion which ranges from surfaces of head corner portions and a head top portion to a depth of 10 mm in a head portion of the rail or in a portion which ranges from the surfaces of the head corner portions and the head top portion to a depth of 20 mm in the head portion is a pearlite structure, the hardness Hv of the head surface portion is in a range of 320 to 500, and an average value of ratios (L/D) of long side lengths (L) to short side lengths (D) of Mn sulfide-based inclusions observed in an arbitrary cross-section taken from a portion ranging from the surface of the head top portion to a depth of 3 mm to 10 mm along a longitudinal direction of the pearlite structure is in a range of 5.0 or lower.

4. The pearlitic rail according to claim 2, wherein

Mn sulfide-based inclusions having long side lengths (L) in a range of 1 μm to 50 μm are present at an amount per unit area in a range of $10/mm^2$ to $100/mm^2$ in an arbitrary cross-section taken along the longitudinal direction of the pearlite structure.

5. A pearlitic rail comprising a steel comprising: in terms of percent by mass, C: 0.65% to 1.20%;

Si: 0.05% to 2.00%;

Mn: 0.05% to 2.00%; and

REM: 0.0005% to 0.0500%, with the balance being Fe and inevitable impurities, wherein, in a head portion of the rail, a head surface portion which ranges from surfaces of head corner portions and a head top portion to a depth of 10 mm has a pearlite structure, and the hardness Hv of the head surface portion is in a range of 320 to 500, wherein an average value of ratios (L/D) of long side lengths (L) to short side lengths (D) of Mn sulfide-based inclusions observed in an arbitrary cross-section taken along a longitudinal direction of the pearlite structure is in a range of 5.0 or lower.

6. The pearlitic rail according to claim 5, wherein the steel further comprises, in terms of percent by mass, $S \leqq 0.0100\%$, and Mn sulfide-based inclusions having long side lengths (L) in a range of 1 μm to 50 μm are present at an amount per unit area in a range of $10/mm^2$ to $100/mm^2$ in an arbitrary cross-section taken along the longitudinal direction of the pearlite structure.

* * * * *